US009045208B2

(12) United States Patent
Bartlett

(10) Patent No.: US 9,045,208 B2
(45) **Date of Patent: *Jun. 2, 2015**

(54) INTERLOCK VESSEL FOR HYPERBARIC TRANSFER SYSTEM

(76) Inventor: Robert D. Bartlett, New Orleans, LA (US)

( * ) Notice: Subject to any disclaimer, the term of this patent is extended or adjusted under 35 U.S.C. 154(b) by 1608 days.

This patent is subject to a terminal disclaimer.

(21) Appl. No.: 12/499,863

(22) Filed: Jul. 9, 2009

(65) Prior Publication Data

US 2010/0037892 A1 Feb. 18, 2010

Related U.S. Application Data

(63) Continuation of application No. PCT/US2007/085471, filed on Nov. 23, 2007, which is a continuation-in-part of application No. 11/893,174, filed on Aug. 15, 2007, now Pat. No. 8,342,353, and a continuation-in-part of application No. 11/626,648, filed on Jan. 24, 2007, now abandoned.

(51) Int. Cl.
*B63C 11/32* (2006.01)

(52) U.S. Cl.
CPC ..... *B63C 11/32* (2013.01)

(58) Field of Classification Search
CPC ..... A61G 10/026; B63C 11/32; B63C 11/325
USPC ..... 128/202.12, 205.26; 220/254.5, 846, 220/845, 848, 324
See application file for complete search history.

(56) References Cited

U.S. PATENT DOCUMENTS

| | | | | | |
|---|---|---|---|---|---|
| 1,450,857 | A | * | 4/1923 | Johnson | 220/830 |
| 1,833,208 | A | * | 11/1931 | Davidson | 220/291 |
| 2,566,008 | A | * | 8/1951 | Westby | 220/203.07 |
| 2,926,012 | A | * | 2/1960 | Maher | 49/68 |
| 3,048,189 | A | | 8/1962 | Chandler | |
| 3,136,007 | A | * | 6/1964 | Maher et al. | 49/68 |
| 3,547,118 | A | * | 12/1970 | Berry et al. | 128/205.26 |
| 3,677,434 | A | * | 7/1972 | Boyer | 220/324 |
| 3,807,656 | A | * | 4/1974 | Fletcher et al. | 244/171.7 |
| 4,376,352 | A | * | 3/1983 | Soininen et al. | 49/68 |
| 4,750,635 | A | | 6/1988 | Piegza et al. | |
| 7,036,674 | B2 | * | 5/2006 | McGuire | 220/263 |
| 7,263,995 | B2 | * | 9/2007 | Gurnee et al. | 128/205.26 |
| 7,796,729 | B2 | * | 9/2010 | O'Brien et al. | 378/65 |
| 7,850,751 | B2 | * | 12/2010 | Steiner | 55/385.1 |
| 2009/0064868 | A1 | * | 3/2009 | Cartossi | 99/337 |

* cited by examiner

*Primary Examiner* — Justine Yu
*Assistant Examiner* — LaToya M Louis
(74) *Attorney, Agent, or Firm* — Brett A. North; Garvey, Smith, Nehrbass & North, LLC.

(57) ABSTRACT

An interlock vessel having an air-tight body with opposing ends. A portion of the body is designed to fit into a decompression (hyperbaric) chamber, wherein a diver or a patient undergoing a decompression treatment is positioned. The opposing ends are closed by pivotally moveable doors and locking assemblies that retain the doors in a closed position until the pressure inside the decompression chamber and the exterior of the chamber can be equalized. The outer door has two locking systems: (a) an interlock system and (b) a safety/delay locking system. Both locking assemblies are manually operated.

24 Claims, 19 Drawing Sheets

FIG. 14
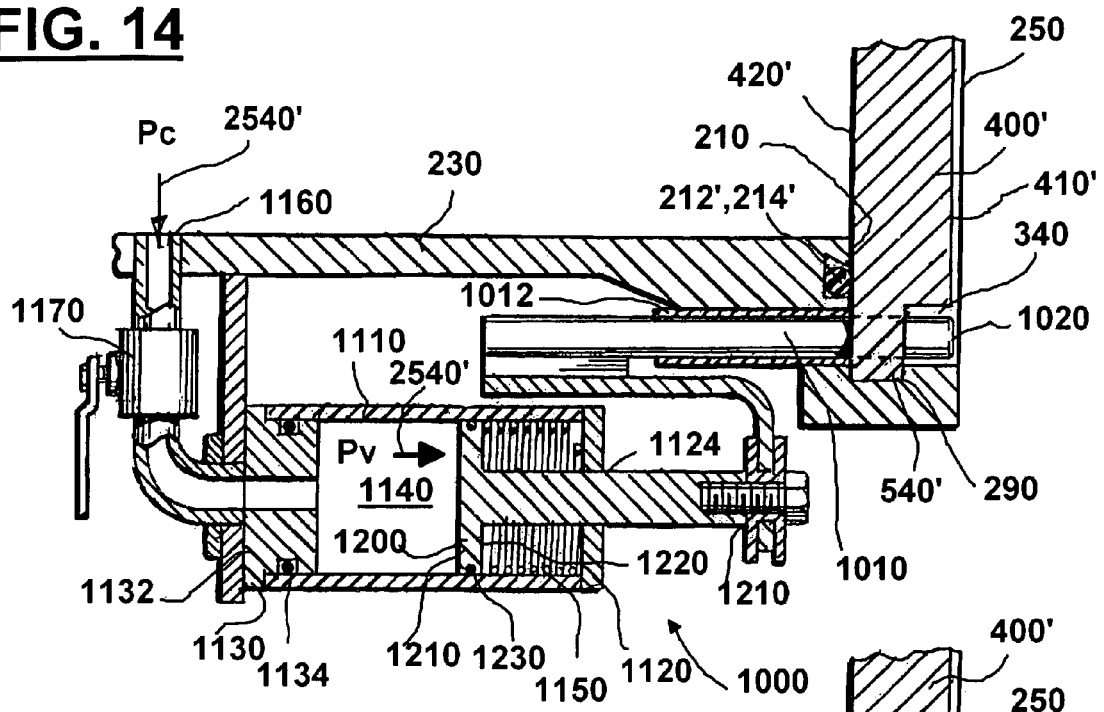
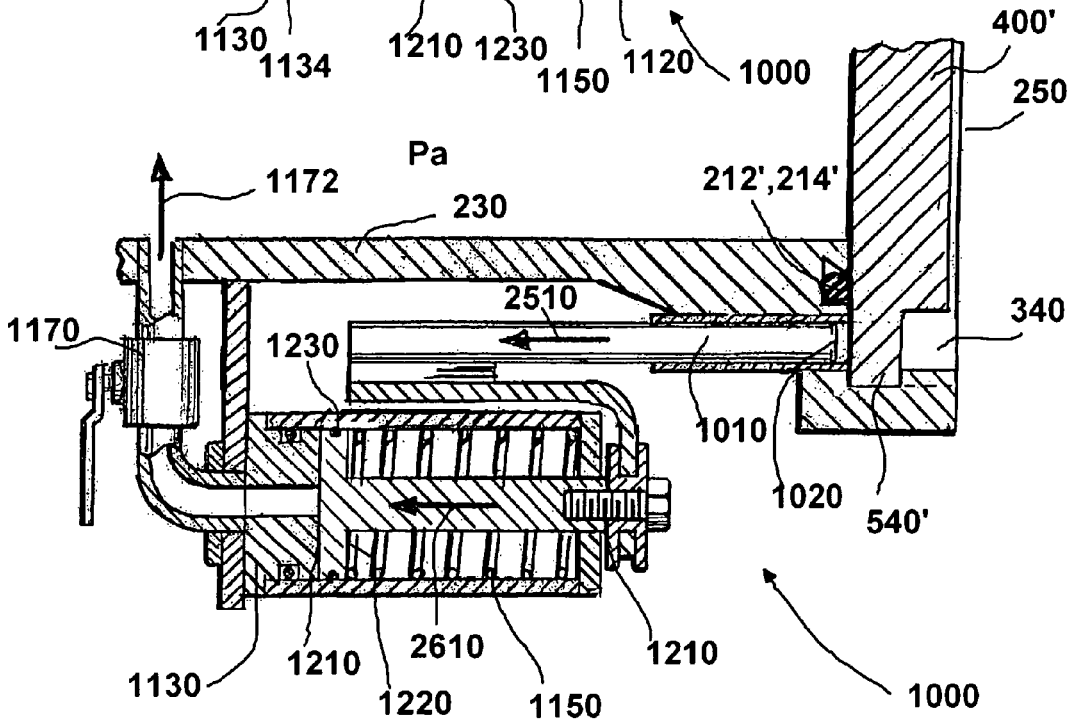
FIG. 15

INTERLOCK VESSEL FOR HYPERBARIC TRANSFER SYSTEM

CROSS-REFERENCE TO RELATED APPLICATIONS

This application is a continuation of PCT Application Serial No. PCT/US07/85471, filed Nov. 23, 2007, which was a continuation-in-part of U.S. patent application Ser. No. 11/893,174, filed Aug. 15, 2007, which application was a continuation-in-part of U.S. patent application Ser. No. 11/626,648, filed 24 Jan. 2007, and priority of each of the above referenced applications is hereby claimed.

PCT Application Serial No. PCT/US07/85471, filed Nov. 23, 2007, is incorporated herein by reference.

U.S. patent application Ser. No. 11/893,174, filed 15 Aug. 2007, is incorporated herein by reference.

U.S. patent application Ser. No. 11/626,648, filed 24 Jan. 2007, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Hyperbaric and/or decompression chambers are used in many applications, and in many situations require the transfer of items either to and/or from the interior of the chambers. For example, deep sea diving, whether for pleasure or work, is associated with a serious risk of trauma to the divers. Without proper treatment, major problems from diving accidents, most commonly decompression sickness (or the "bends") and Air Embolism, can lead to permanent disabling injuries and in some instances be fatal. Conventionally, offshore rig divers who work at great depths for considerable amounts of time must undergo decompression for extended periods time (e.g., up to two weeks). Normally the decomposition takes place in a conventional decompression chamber on the offshore rig or on a deck of a dive boat.

Dive chambers are examples of a category of pressure vessel referred to as a pressure vessel for human occupancy ("PVHO"). Once the divers are inside the vessels of the transfer system their condition must be kept stable. In keeping with this objective the problem arises of keeping the gas mixtures constant within the vessels of the transfer system. This includes both the pressures and concentrations of the compression gas, the breathing gas and the oxygen within the chamber. It is especially true for the oxygen supply within the vessel which must be replenished as it is used.

While the individual is in the decompression chamber, if medicines, supplies, food, drink, or other items are to be provided to the individual, a method and apparatus for supplying such items without substantially impacting the interior pressure and gas concentration inside the chamber needs to be provided. Additionally, it is desirable that in making this transfer that a minimum amount of interior gas pressure and/or gas concentration is lost.

One conventional method for providing access to the individual while inside the chamber is through an air lock which is independent of the entrance to the chamber. The air lock on a dive chamber can include a steel tube penetrating the chamber's wall. The steel tube can have doors called "closures" on each end.

Certain design conditions need to be addressed for an air lock or transfer portal to a decompression chamber. For example, in a portal with outer and inner doors, the outer door should be able to withstand the internal pressure of the dive chamber when the inner door is open.

In one embodiment a quick lock/quick unlock can be provided for the outer door. In one embodiment the quick lock/quick unlock for a small diameter portal can include a breech-lock type "two-ring" design familiar to those skilled in the art of quick opening closures. A two-ring style door can use a body ring welded to the body of the portal which rotatably houses a door. In one embodiment the door can have a plurality of radial extending protrusions. In one embodiment the body ring can have a plurality of enlarged openings which correspond to the plurality of radially extending protrusions of the door. In one embodiment the door can be rotated relative to the ring such that the plurality of radially extending protrusions slidable lock with the ring and prevent longitudinal movement of the door relative to the portal thereby keeping the door closed. In one embodiment the outer door can be rotated relative to the ring such that the plurality of radially extending protrusions enter the plurality of enlarged openings so that longitudinal movement of the door relative to the portal is allowable thereby allowing the door to be opened.

In one embodiment one or more of the plurality of radially extending protrusions can have a sloped section (in a rotational direction), such that when the outer door is rotated in the direction of slope the door tends to move in a longitudinal direction towards the interior of the portal. In this way the seal between the exterior door and the portal (such as an O-ring) can be more tightly sealed or energized. In one embodiment a perimeter groove in the ring can include a plurality of sloped sections such that when the outer door is rotated in a first direction the door tends to move in a longitudinal direction towards the interior of the portal causing a tighter seal to be made between the door and the portal. In one embodiment corresponding sloped areas are provided on both the plurality of radially extending protrusions of the exterior door and the plurality of sloped sections by the corresponding plurality of enlarged openings, such that both sloped portions tend to cause the door to more tightly seal against the portal when the door is rotated.

In some instances "three-ring" closures can be used on outer doors. In three-ring closures the door and body ring (first and second rings) do not rotate. Instead, a third ring (locking ring) located outside of the door and body rings itself rotates to engage mating lugs on the door and/or body rings and thereby obtain a seal. Two ring closures are preferred over three ring closures for various reasons: two ring closures are less expensive because they do not have a third ring; do not require lubrication of the sliding surfaces of this third ring; and do not have high stress areas hidden under such a third ring (which can inhibit a pre-failure detection analysis). Advantages of two ring versus three ring closures are particularly useful in competitive commercial applications such as dive chambers where they are subjected to harsh outdoor marine environments.

One hazard for conventional locks for closures is that the operator can attempt to open the air lock while the door is under pressure. As a consequence of this pressure differential, the door can be forced open very fast and the operator can be injured or the person inside the chamber can be injured by the inner door swinging open explosively.

Conventional locks for preventing two-ring closures from being opened while under pressure rely on indicators. Examples of "indicators" include pressure gages or pressure actuated spring loaded pop-up pistons. However, indicators only "notify/flag" operators, and depend on the operator recognizing and acting on the information provided by the indicators. Additionally, spring-loaded piston indicators retract when a small pressure still remains in the closure so that a false "OK" signal can be communicated. Even relatively small pressure differentials between the interior of the portals and the area where the closure is being opened can cause large forces on the closures and cause them to open fast causing injury.

Another potential problem with two-ring closures (or doors) relates to the door support allowing the door to both "swing out" (e.g., open and close) but also rotate about its axis (for locking/sealing and unlocking/unsealing). Because two distinct movements are required, a two-ring door hinge typically connects the door using a longitudinal bearing in the hinge blade which longitudinal bearing supports an axle in the center of the door. However, these bearings eventually wear, and such wear allows changes in concentric alignments of the door relative to the locking ring.

Alignment of the door relative to the locking ring is important because O-rings are preferred for sealing. O-rings (which are self-energizing gaskets) use the pressure of the fluid or gas being sealed to contribute to (or energize) their sealing effect. O-ring seals require containment in a cavity with limited gaps to prevent a form of failure referred to as "extrusion." Extrusion failure of O-rings and the design gap sizes required to prevent it are described in O-ring design handbooks such as the "Parker O-Ring Handbook" and are familiar to those skilled in the art of O-ring joint design. For a closure where human life depends on its proper operation a concentricity misalignment of the door which leads to a gap and possible extrusion failure is unacceptable.

Conventionally available locks can be interlocks which are devices constraining the operator from opening the closure (door) until after the air locked has started to vent. Conventional interlocks for two-ring doors include threaded vent plugs in the door which vent plugs are chained to a stationary part of the vessel. These "vent-plug-on-chains interlocks" can restrict opening of the door, but they are slow and awkward.

Another problem with dive chamber air locks relates to the operation of the inner closure or door. Interior pressures of chambers are typically elevated compared to outside pressures. Because the inner door swings inwards when opening, the higher interior pressure of the dive chamber (or living space), compared to the pressure outside the chamber, causes the inner door to be pushed against the portal and pushed against a sealing O-ring (between the interior door and the portal). The force created by the higher interior pressure energizes the sealing O-ring, and seals the interior from the portal. Because of this higher interior pressure the inner door does not require a lock (or locking ring) to create a seal when in use and pressurized. However, dive chambers are not always in use and pressurized and when on ships, and when not pressurized dive chambers can be subjected to large jerking motions (such as wave action) causing the "unlocked" inner door to swing open and shut causing damage. Also, large motions can be seen during other activities of ships such as during the discharge if cargo which can cause an unlatched inner door to swing open and closed on its own. Additionally, dive chambers can be transported from one ship to another location such as by truck also subjecting the dive chamber to large jerking motions. During periods in which a dive chamber is subjected to large jerking motions, an "unsecured inner door" can bounce open and closed, which can cause damage to the inner door, O-ring, and/or portal.

Furthermore, if the inner door is somehow opened when the interior of the dive chamber is pressurized but unoccupied, a person standing outside the dive chamber would be unable to reach through the outer door and grab hold and close the inner door. However, even assuming that the interior door can be reached from the exterior, attempting to close the inner door from the exterior is very dangerous because the increased interior pressure can cause the interior door to slam shut very quickly, which slamming shut can harm the person attempting to close.

A seemingly simple solution for the interior door is to use a swing bolt latch or other clamping latch. However, swing bolts or clamping latches have the disadvantage of continuing to hold shut the inner door even where the portal pressure (or exterior pressure) is substantially greater than the interior dive chamber pressure. For example, locked swing bolts or clamping latches can trap elevated pressures inside the portal as the interior pressure of the dive chamber is reduced during a depressurization cycle. A trapped high differential pressure behind the inner door risks this door being slammed open and harming a person in the interior of the dive chamber—such as where the swing bolt or clamping latch is released (or fails) with a trapped high differential pressure behind the inner door. Such a condition could lead to an explosive release of the inner door.

Another disadvantage with conventionally available air locks (or access portals) is their lack of dealing with the time delay between: (a) starting the venting process of the interior of the portal and (b) the finishing of the venting process. Even where an interlock is used on the outer door to start venting and also "unlock" the outer door, a time lag exists between the start of the venting process to the time where the pressure differential between the interior of the portal and the exterior is at an acceptable level so that the outer door is not cause to explosively swing open.

BRIEF SUMMARY

In one embodiment is provided an interlock assembly for use with an air lock or portal fluidly connected to decompression or hyperbaric chambers. In one embodiment this air lock converts the decompression or hyperbaric chamber to a hyperbaric transfer system.

In one embodiment the decompression chamber can be cylindrical in shape with a sidewall forming the cylinder.

In one embodiment is provided an interlock air lock assembly for use with decompression chambers or hyperbaric chambers. The interlock assembly can be a portal comprising a hollow air tight vessel with open ends which are selectively closed/opened by a respective inner door and an outer door.

In one embodiment is provided a portal having a body with a sidewall extending between the opposite ends, and the inner door and the outer door having hinged assemblies that are secured to the body for pivotal movement of the doors.

In one embodiment the air lock or portal can be attached to the sidewall of the decompression or hyperbaric chamber.

In one embodiment one or both the inner door and/or the outer door can be equipped with latch assemblies for safely closing the doors to maintain an air tight environment.

In one embodiment the outer door can be also rotatable in relation to the portal. In one embodiment the outer door can be both rotatable and pivotal in relation to the portal.

In another embodiment is provided an interlock assembly that has a plurality of locking/latching safety locks which prevent an undesirable rapid venting of the decompression chamber wherein a diver and/or patient is situated.

In one embodiment the inner door is mounted at an interior end of the vessel in fluid communication with the decompression chamber when the inner door is open.

In one embodiment one or both the inner door and the outer door can be provided with seals (such as sealing O-ring fitted on the inside surface of the respective door) to facilitate the air tight engagement of the door with the body of the portal.

In one embodiment is provided a locking ring mounted at the outside edge of the vessel or portal allowing at least one locking bar to selectively extend therethrough (from the rear) to prevent undesirable rotation and opening of the outer door at a time when the vessel or portal is at an elevated pressure.

In one embodiment is provided a quick lock/quick unlock interlock system which both releases a lock against rotation of the outer door and starts venting the interior of the portal.

In one embodiment a pressure relief valve can be operatively connected to the locking member for rapidly venting pressure inside the portal when the quick lock/quick unlock is switched to an open state.

In one embodiment is provided a venting valve which is operably connected to a sliding locking member.

In one embodiment the venting valve is fluidly connected to the sidewall of the body of the air lock or portal.

In one embodiment the operative connection between the venting valve and sliding locking bar is made through a four bar linkage system which includes a slider.

In one embodiment the slider connection passes through a locking ring of the portal from the rear of the locking ring.

In one embodiment the slider connection has a first end and when it moves from the unlocked state to the locked state the first end moves away from the inner door and towards the outer door.

In one embodiment the slider connection has a first end and when it moves from the locked state to the unlocked state the first end moves away from the outer door and towards the inner door. In one embodiment the slider connection has a first end and when it moves from the unlocked state to the locked state the first end moves away from the inner door (at a time which the first end is between a plane bisecting a perimeter groove and the inner door) and towards the outer door (the first end passing through the bisecting plane).

In one embodiment the slider connection has a first end and when it moves from the locked state to the unlocked state the first end moves away from the outer door (at a time which the first end is in front of a plane bisecting a perimeter groove and the inner door) and towards the outer door (the first end passing through the bisecting plane).

In one embodiment the slider connection has a first end and when it moves to the locked condition the first end passes from behind the middle of the locking ring to in front of the locking ring.

In one embodiment the slider connection has a first end and when it moves to the unlocked condition the first end passes from in front of the middle of the locking ring to behind the middle of the locking ring.

In one embodiment the slider connection has a locking bar and the locking bar is located between the exterior of the sidewall of the portal and the outside of the locking ring.

In one embodiment a quick lock/quick unlock sensitive to the pressure differential between the interior of the portal and the exterior can be used to rotational lock the outer door.

In one embodiment the pressure sensitive quick lock/quick unlock can be a second lock in addition to an interlock quick lock/quick unlock.

In one embodiment the second lock can be operatively connected to the first lock, switching from open to closed (or from closed to open) states in a time delayed manner relative to the first lock.

In one embodiment is provided a safety lock/unlock which will generally take between about 1, 2, 3, 4, 5, 6, 7, 8, 9, 10, 15, 20, 25, 30, 35, 40, 45, 50, 55, and 60 seconds to unlock from the start of venting of the interior of the portal and the time the quick lock/quick unlock enters an unlocked state. In various embodiments ranges between any of the above referenced time delays are envisioned.

In one embodiment is provided a safety lock/unlock which will generally enter an unlocked stated when the different between the interior pressure of the portal and the exterior is below a specified safety level. In one embodiment the acceptable differential is less than about 5 psi, 4 psi, 3 psi, 2 psi, 1 psi, and/or ½ psi (34.5, 27.6, 20.7, 13.8, 6.9, and/or 3.4 kilopascals). In various embodiments ranges between any of the above referenced pressure differentials are envisioned.

In one embodiment the amount of rotation of the outer door is limited in both first and second directions. In one embodiment this rotational limit is obtained by a slot and pin mechanism.

In one embodiment rotation of the outer door causes the door to tighten (shut more securely and seal) relative to the interior of the portal.

In one embodiment a seal is set up between the inner door and the interior of the dive chamber when the pressure of the interior of the dive chamber becomes greater than the pressure of the interior of the portal.

In one embodiment the interior door includes a latching mechanism which opens partially based on a differential higher pressure between the interior of the portal and the interior of the dive chamber. Such partial opening allows the interior of the portal to vent into the interior of the chamber.

In one embodiment the latching mechanism includes first, second, and third latching conditions, where the first latching condition is entered when the inner door seals the interior of the chamber from the interior of the portal, the second latching condition includes a partial opening of the inner door so that venting occurs from the interior of the portal to the interior of the chamber, and the third latching condition is an open condition—where the inner door is no longer constrained by the latch.

In one embodiment, when the interior pressure of the portal exceeds the interior pressure of the dive chamber the latching mechanism moves from the first latching condition to the second latching condition and allows pressure to vent from the interior of the portal to the interior of the dive chamber but restricts the extent to which the interior door can open. In one embodiment the inner door can open less than about 1/200, 1/100, 1/90, 1/80, 1/70, 1/60, 1/50, 1/40, 1/30, 1/20, 1/10, ½, 1, 1½, 2, 2½ 3, 4, 5, 6, 7, 8, 9, and 10 millimeters. In various embodiments ranges between any of the above referenced distances are envisioned.

In one embodiment the latching mechanism on the inner door includes a spring which is biased to cause the latch to move in a latched condition.

In one embodiment the latching mechanism includes a handle which has first and second sloped portions, the first sloped portion tending to be sloped towards the longitudinal centerline of the portal, and the second sloped portion tending to be sloped away from the longitudinal centerline of the portal.

In one embodiment the inner door includes a quick connect/quick disconnect mechanism for attaching to the interior end of the portal.

In one embodiment the inner door includes a floating connection with its hinge, this floating connection assisting in aligning the door with the interior opening of the portal. In one embodiment the inner door includes a centrally protruding section which can assist in aligning concentrically the inner door with the interior opening of the portal.

In one embodiment the inner door includes a venting valve for venting between the interior of the chamber and the interior of the portal. In one embodiment the venting valve can be located on the body of the air lock or portal.

In one embodiment the inner door rotates about an axis which is included in a horizontal plane.

In one embodiment the inner door rotates about an axis which is included in a vertical plane.

In one embodiment the outer door rotates about an axis which is included in a horizontal plane.

In one embodiment the outer door rotates about an axis which is included in a vertical plane.

BRIEF DESCRIPTION OF THE DRAWINGS

Reference will now be made to the drawings, wherein like parts are designated by like numerals, and wherein

FIG. 14 is a sectional view of the safety or delayed locking system which is pressure sensitive and which is shown in a locked state.

FIG. 15 is a sectional view of the safety or delayed locking system which is pressure sensitive and which is shown in an unlocked state.

DETAILED DESCRIPTION

Turning now to the drawings in more detail an airlock assembly or portal is generally designated by numeral 200. In the following description, the terms "portal," "airlock assembly," "interlock vessel," and interlock assembly are used interchangeably. The portal 200 is designed to be used in a hyperbaric chamber (e.g., decompression chamber) 10 transfer system.

Figure 1:
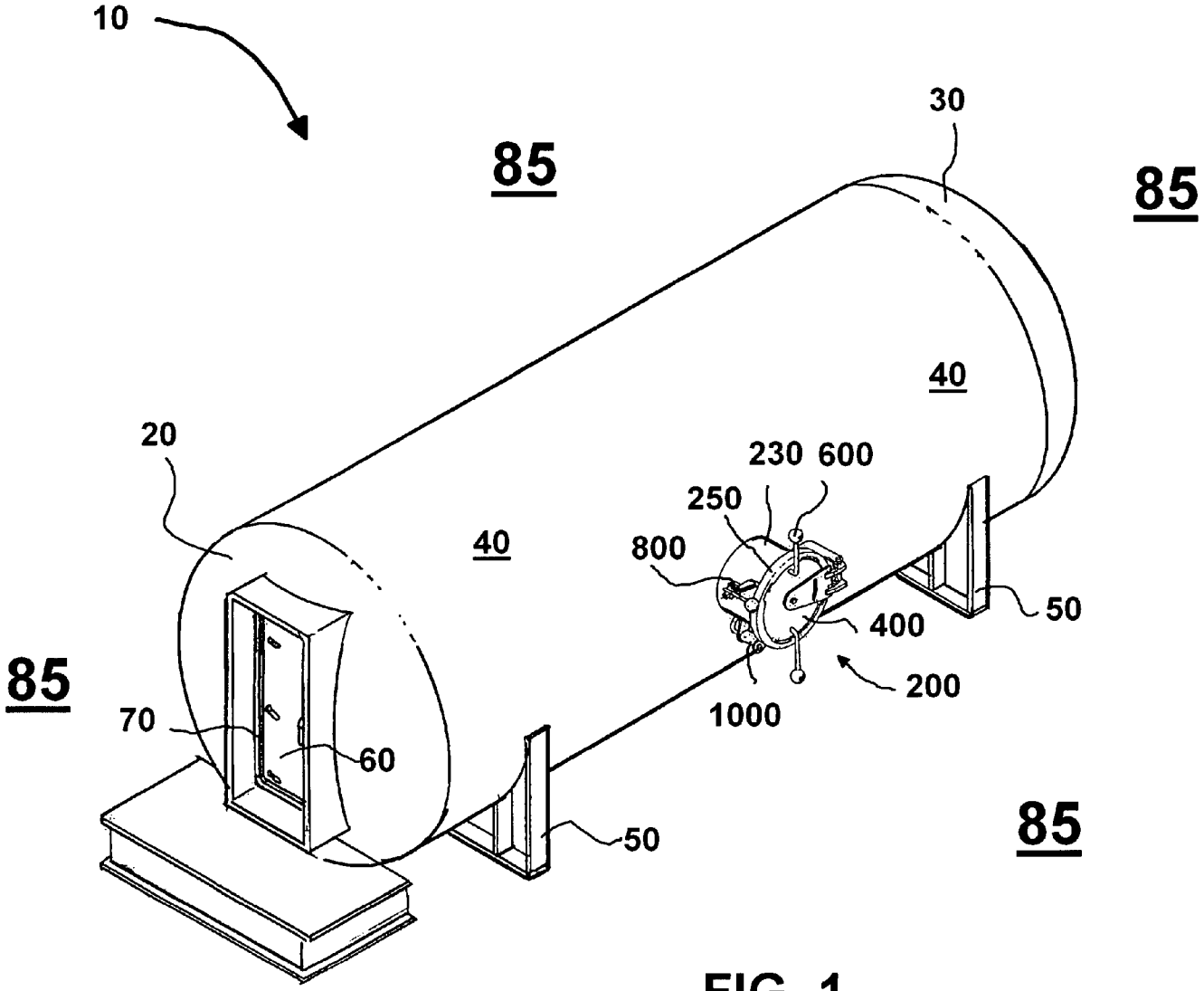
FIG. 1 is a perspective view of a decompression chamber with air lock or portal.

FIG. 1 is a perspective view of a decompression chamber 10 with air lock or portal 200. In one embodiment a decompression chamber 10 having a fluidly connected portal 200 is included. Decompression chamber 10 can include first end 20, second end 30, and side wall 40. Base 50 can be included to support chamber 10. For entering chamber 10 a door 60 can be provided. Door 60 can be sealed with conventionally available seal 70. Chamber 10 can have interior 80, and sidewall 40 can separate interior 80 from the exterior 85 (or ambient environment). Preferably, door 60 opens to the interior 80 of chamber 10.

As will be described below, portal 200 can be used to transmit one or more items from the exterior 85 to the interior 80, while the interior 80 is at elevated pressures. Additionally, as will be described below, portal 200 can be used to transmit one or more items from the interior 80 to the exterior 85, while the interior is at elevated pressures.

While chamber 10 is at elevated pressures with a person in the interior 80 of chamber 10, there arises the need to quickly and easily transmit one or more items to such person, or receive one or more items from such person while maintaining chamber 10 at elevated pressures. For example, food and/or medicines may need to be provided to the person inside the chamber while the person is going through a decompression cycle while chamber 10 is maintained at elevated pressures. Such quick access is preferably obtained without substantially impacting the elevated internal 80 pressure Pc of chamber 10. Portal 200 allows such access without substantially impacting the elevated pressure of interior 80 because the volume of interior 204 of portal 200 is typically much less than the volume of interior 80 of chamber 10. Portal 200 is preferred to an airlock device by door 60 because such air lock device would substantially reduce the available space in interior 80 of chamber 10, along with slowing down the time necessary to transfer one or more items (and possibly impacting the elevated pressures of interior 80).

Figure 2:
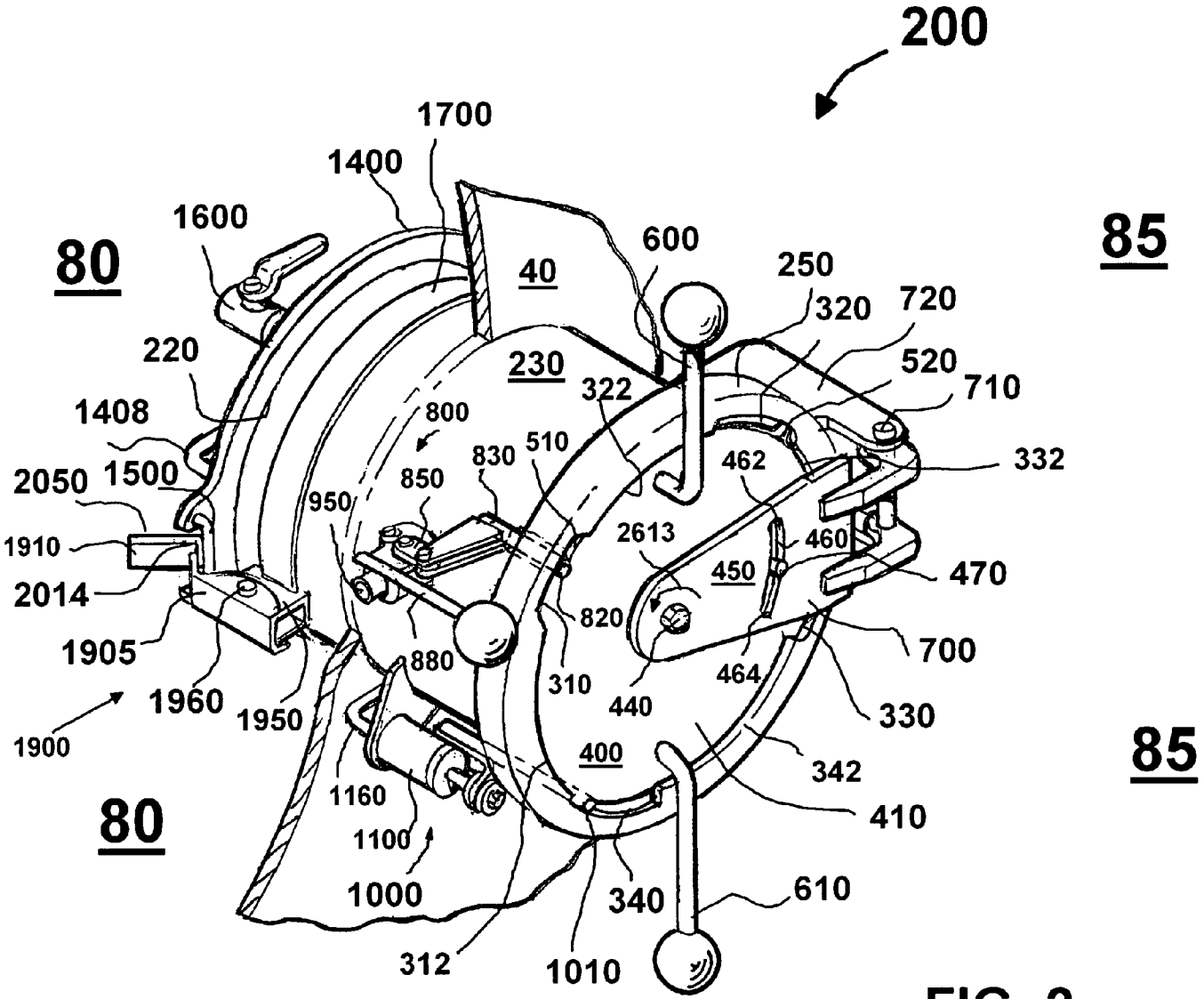
FIG. 2 is an enlarged perspective view of the interlocking air lock or portal of FIG. 1 looking at the portal from the front of the chamber, and where a portion of the sidewall of the decompression chamber has been removed to show the inner and outer ends of the portal.
Figure 3:
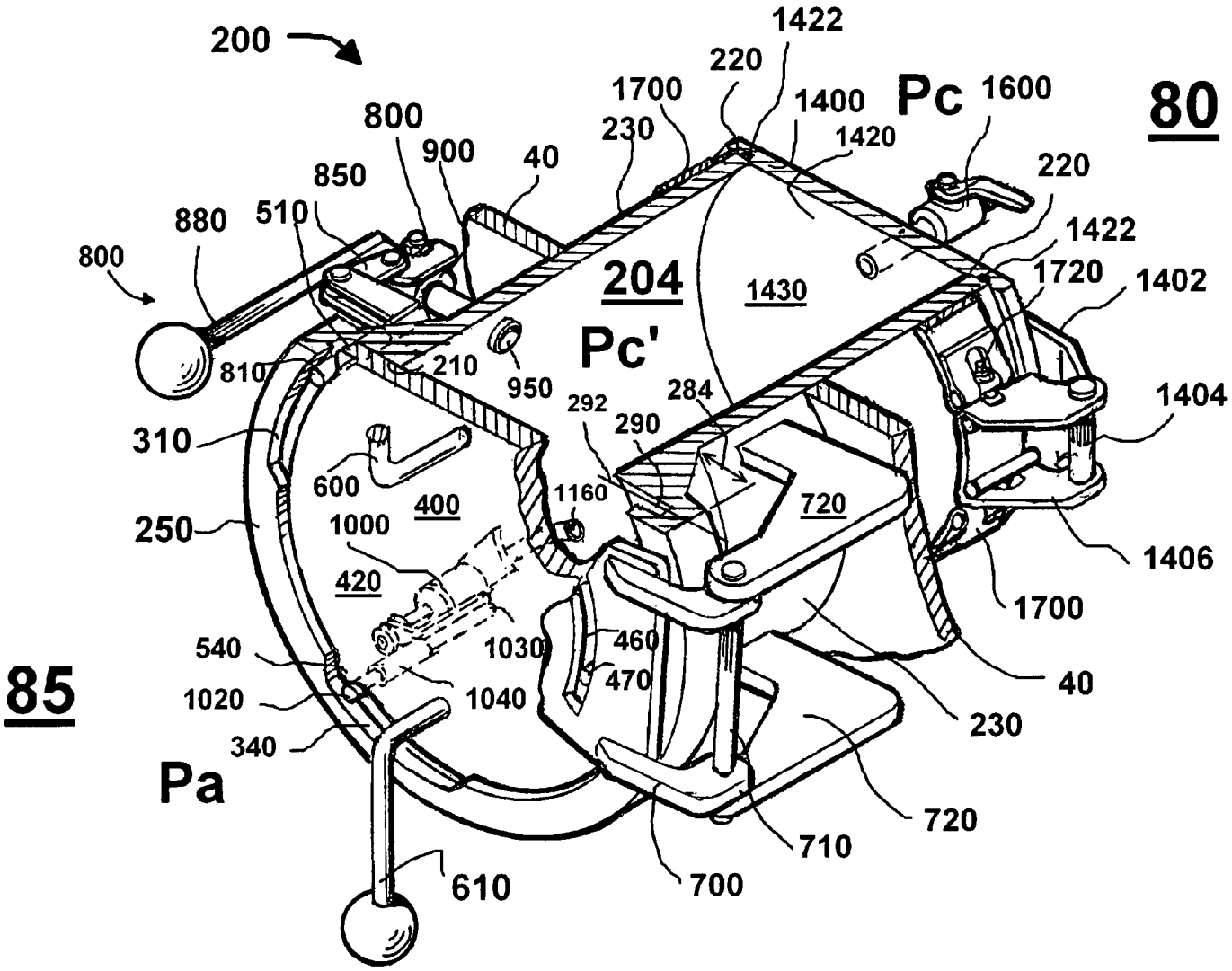
FIG. 3 is an enlarged perspective view of the interlocking air lock or portal of FIG. 2, but now looking at the portal from the rear of the chamber and where a portion of the upper section of the portal has been removed to reveal the interior of the portal.
Figure 4:
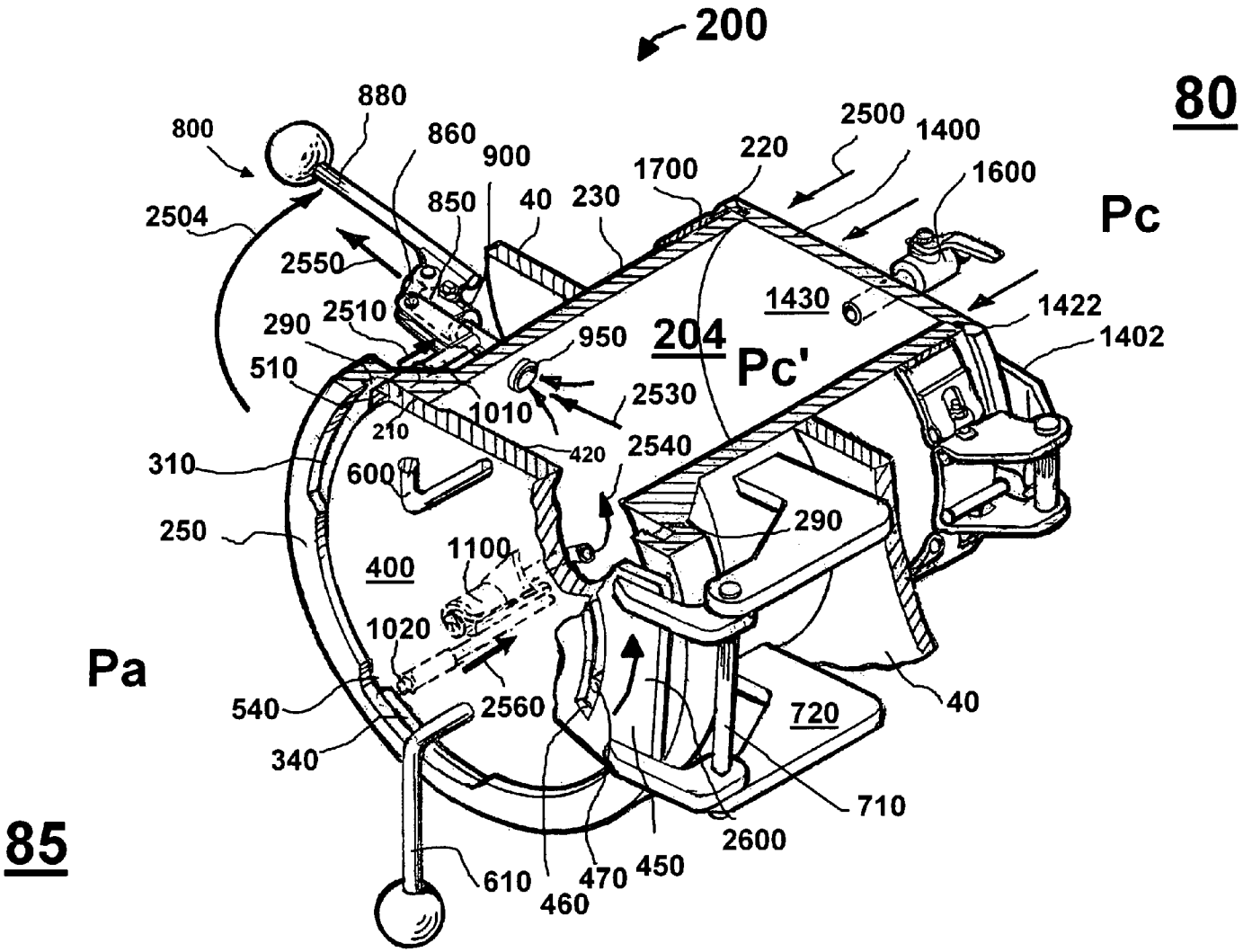
FIG. 4 is an enlarged perspective view of the interlocking portal of FIG. 2, showing the quick lock/quick unlock system now placed in an unlocked state along with schematically showing the venting of the interior of the portal, and the safety or delayed lock system being pressure sensitive and moving from a locked to an unlocked state.
Figure 5:
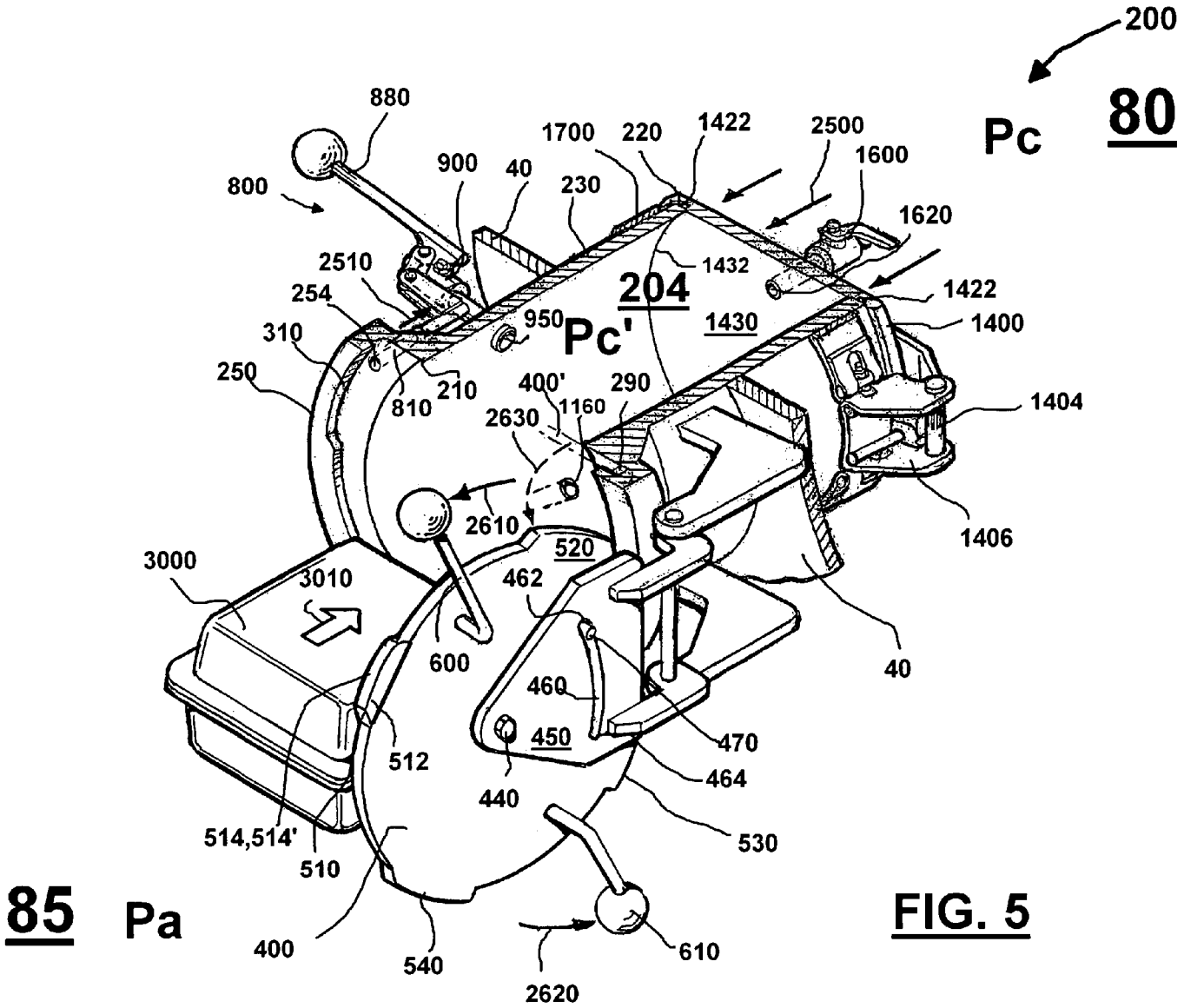
FIG. 5 is an enlarged perspective view of the interlocking air lock or portal of FIG. 2 with the outer door opened and schematically showing an item being placed in the interior of the portal.
Figure 6:
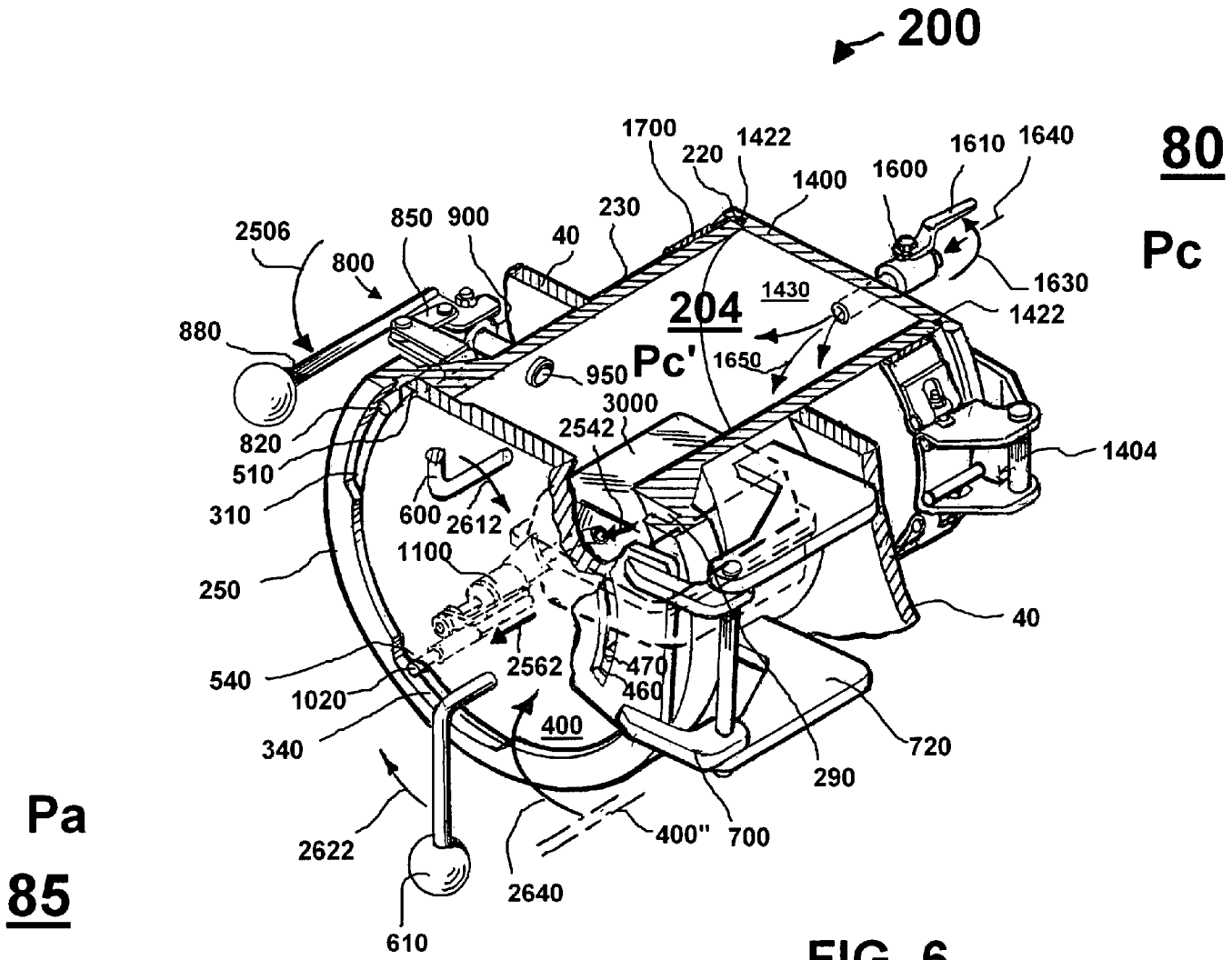
FIG. 6 is an enlarged perspective view of the interlocking air lock or portal of FIG. 2 showing the item placed in the portal with the outer door closed, and the quick lock/quick unlock system now placed in a locked state, and the venting valve on the inner door opened to vent pressure from the interior of the dive chamber to the interior of the portal, and the safety or delayed locking system being pressure sensitive and moving from an unlocked state to a locked state.
Figure 7:
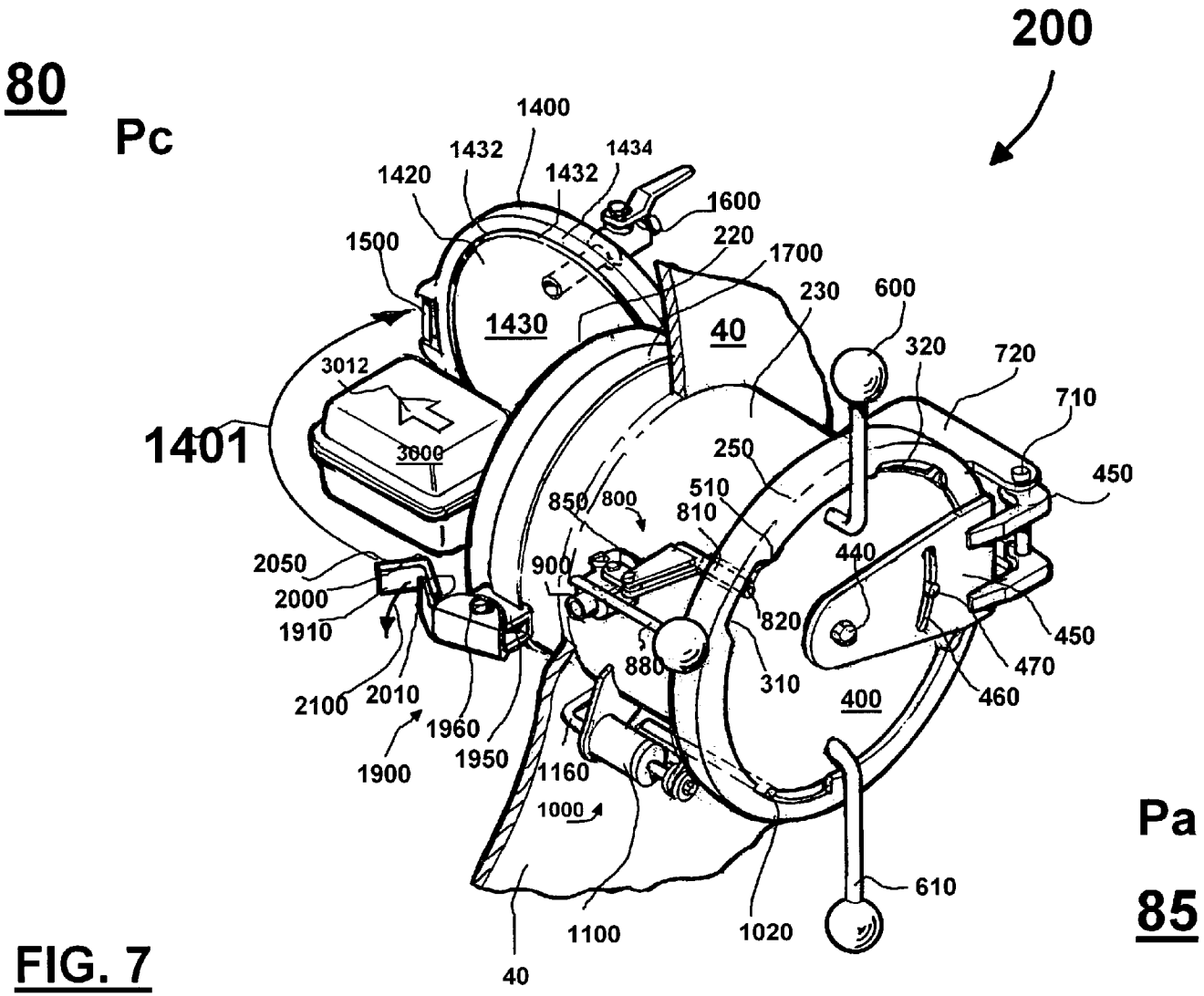
FIG. 7 is an enlarged perspective view of the interlocking portal of FIG. 2 showing the inner door being opened and the item being moved from the interior of the portal to the interior of the dive chamber.

FIGS. 2 through 7 show the process of an item 3000 being transmitted through portal 200 to the interior 80 of chamber 10. FIG. 2 is an enlarged perspective view of interlocking portal 200 at the portal from the front of the chamber 10, and where a portion of the sidewall 40 of the decompression chamber has been removed to show the front 210 and rear 220 ends of the portal. FIG. 3 is an enlarged perspective view of portal 200, but now looking at the portal from the rear 30 of the chamber 10 and where a portion of the upper section of the portal 200 has been removed to reveal the interior 204 of portal 200. FIG. 4 is an enlarged perspective view of portal 200, but showing the interlocking system (lock 800 and safety lock 1000) now placed in an unlocked state along with schematically showing the venting of the interior 204 of the portal 200, and the second pressure sensitive locking mechanism 1000 moving from a locked to an unlocked state. FIG. 5 is an enlarged perspective view of the interlocking portal 200 with outer door 400 opened and schematically showing an item 3000 being placed in the interior 204 of the portal 200. FIG. 6 is an enlarged perspective view of portal 200 showing the item 3000 placed in the portal 200 with outer door 400 closed and the interlocked system (lock 800 and 1000) now placed in locked states, and the venting valve 1600 on the inner door 1400 opened to vent pressure from the interior 80 of the dive chamber 10 to the interior 204 of the portal 200, and the second pressure sensitive locking mechanism 1000 moving from an unlocked state to a locked state. FIG. 7 is an enlarged perspective view portal 200 showing the inner door 1400 being opened and the item 3000 being moved from the interior 204 of the portal 200 to the interior 80 of the dive chamber 10.

Figure 8:
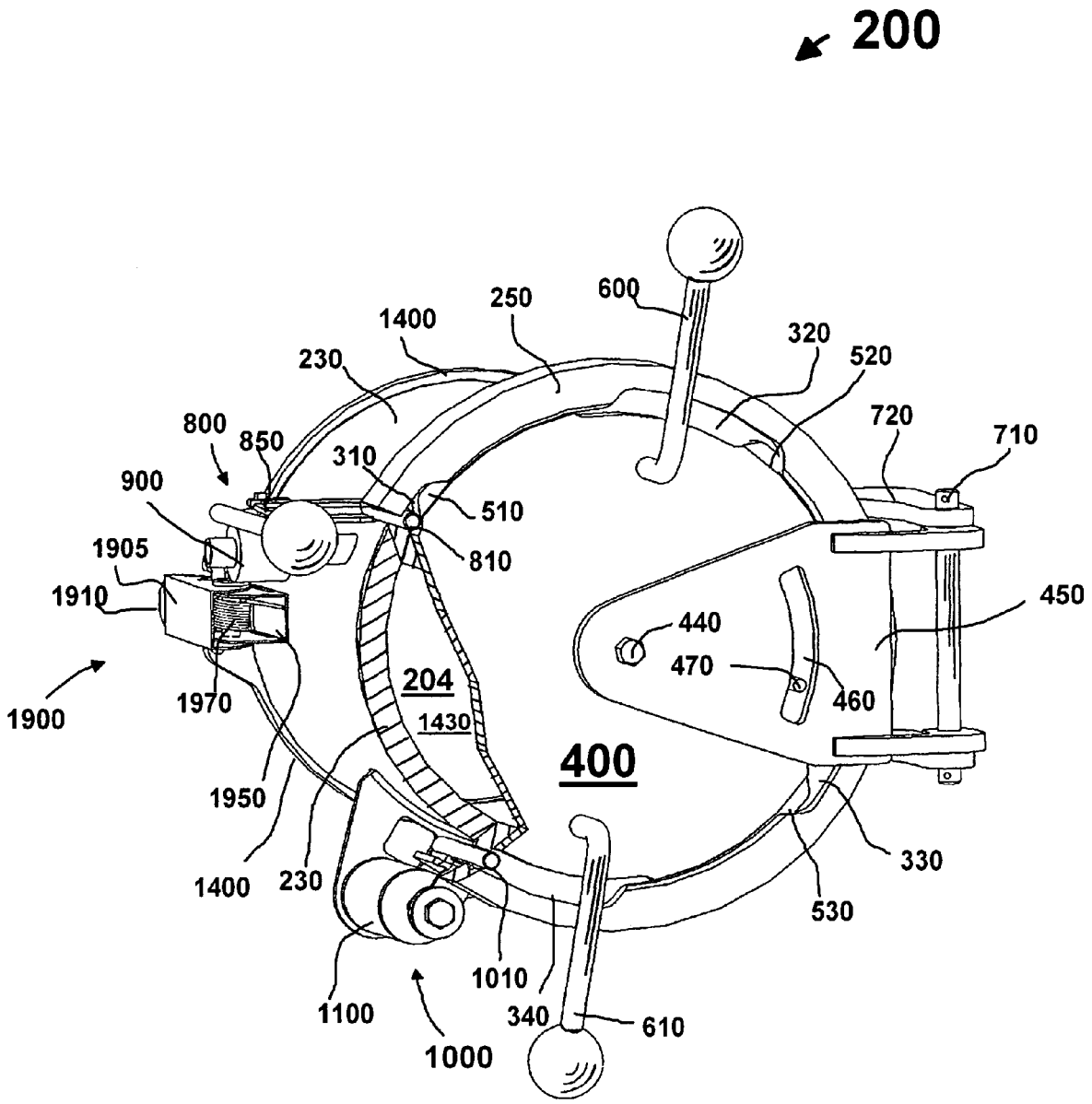
FIG. 8 is a perspective view of the interlocking air lock or portal of FIG. 2, where a portion of the outer door and locking ring has been removed to show the body of the portal along with the quick lock/quick unlock and safety or delayed locking systems.
Figure 9:
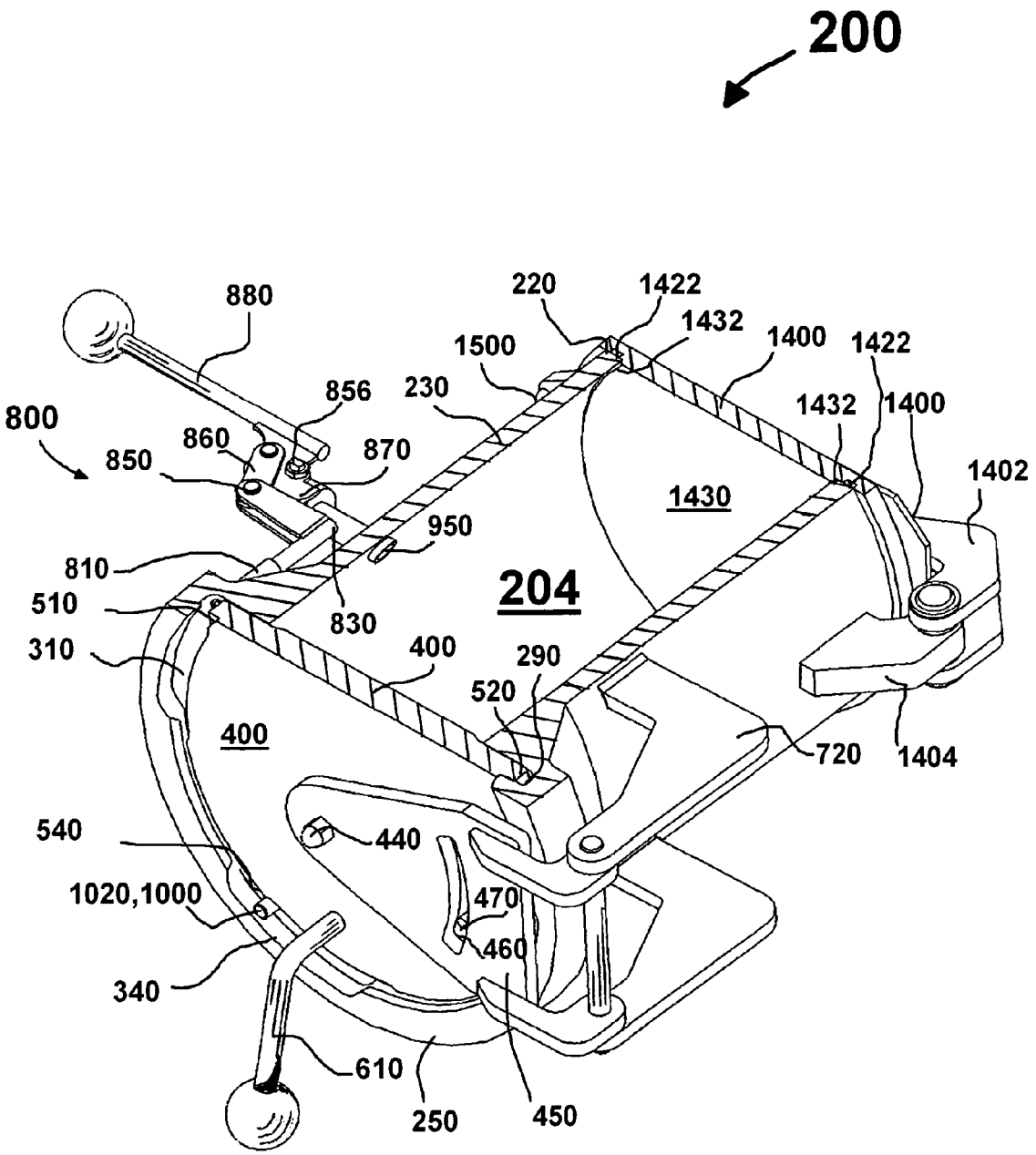
FIG. 9 is a perspective view of the interlocking air lock or portal of FIG. 4 with the quick lock/quick unlock locking member placed in an unlocked state and the safety or delayed locking system's locking member remaining in a locked state.
Figure 10:
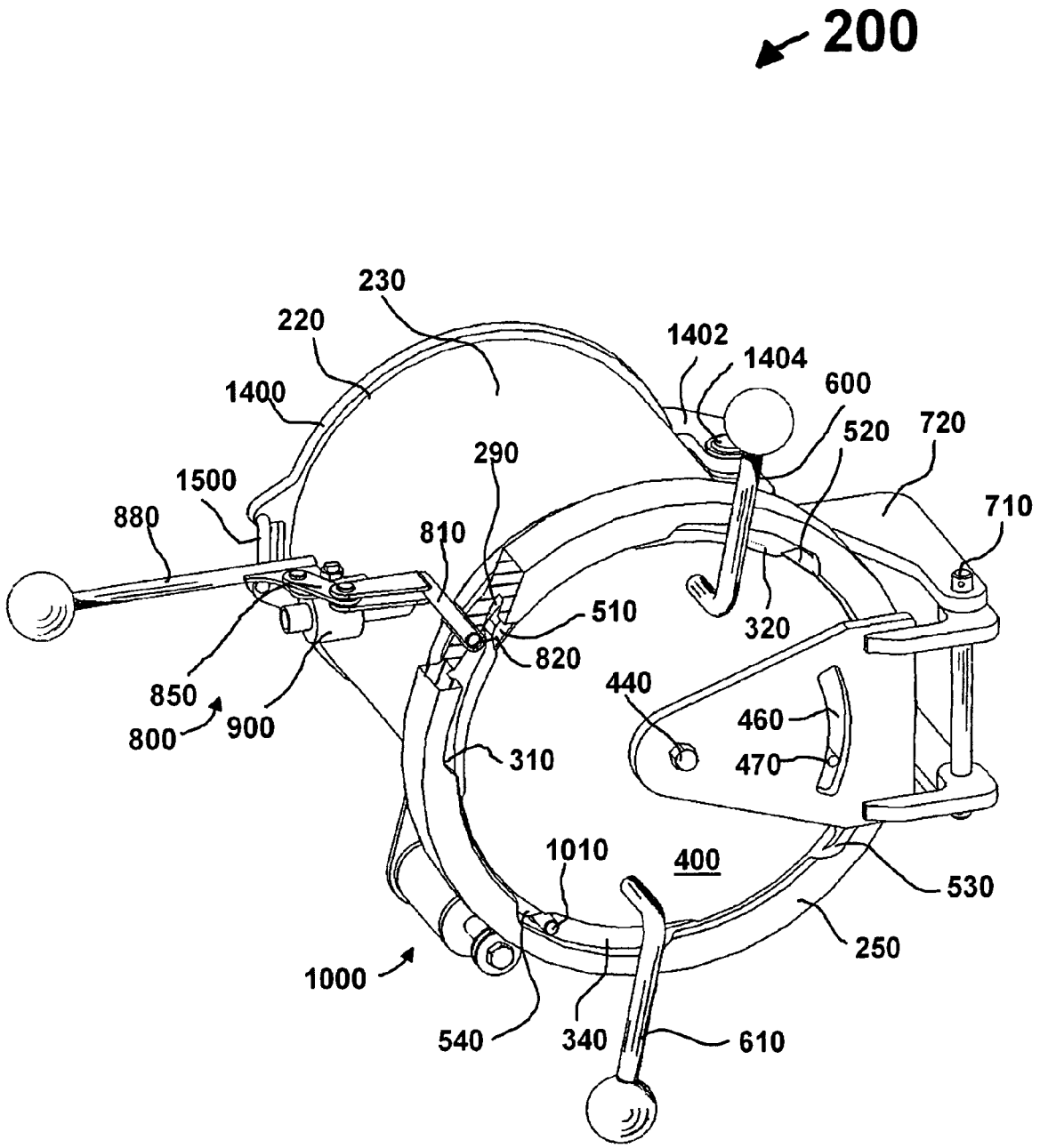
FIG. 10 is perspective view of the interlocking portal of FIG. 2 with a portion of the locking ring removed to show the interaction between the first locking rod and of one of the radial protrusions of the outer door, and also showing the interaction between the second locking rod and another of the radial protrusions.
Figure 11:
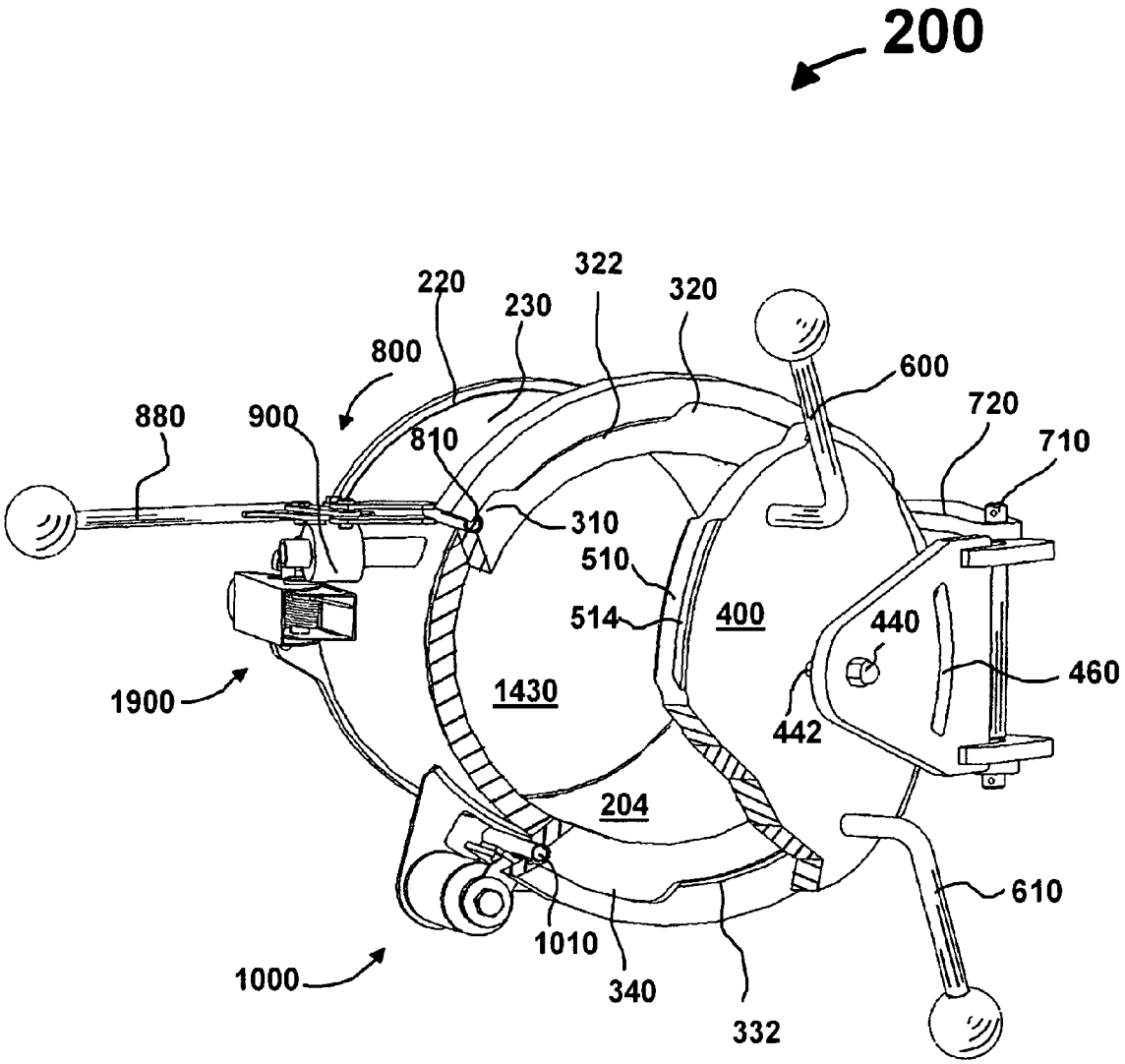
FIG. 11 is perspective view of the interlocking portal of FIG. 2 with the outer door opened and a portion of the locking ring and outer door removed to show the body of the portal along with the quick lock/quick unlock and safety or delayed locking systems.

FIGS. 8 through 11 show various views of one embodiment of portal 200. FIG. 8 is a perspective view of portal 200, where a portion of outer door 400 and locking ring 250 has been removed to show first end 210 body 230 along with quick lock/quick unlock 800 and safety lock 1000. FIG. 9 is a perspective view of portal 200 with quick lock/quick unlock 800 placed in a unlocked state and safety lock 1000 in a locked state. FIG. 10 is perspective view of portal 200 with a portion of locking ring 250 removed to show the interaction between the locking bar 810 and of one of the radial protrusions 510 of outer door 400, and also showing the interaction between locking bar 1010 and another of radial protrusions 540. FIG. 11 is perspective view of portal 200 with outer door 400 opened and a portion of locking ring 250 and outer door 400 removed to show the first end 210 of portal 200 body 230 along with quick lock/quick unlock 800 and safety lock 1000 systems.

Portal 200 can comprise body 230 with first end 210 and second end 220. Between first and second ends 210,220 and body 230 can be interior 214. Body 230 can have a continuous sidewall 240 which can be configured to form a cylindrical vessel. On first end 210 of body 230 can be an outwardly extending shoulder 211, on which outer door 400 contacts when closed. In one embodiment portal 200 comprises an airtight body 230 closed on one end by an inner door 1400 and closed on the opposite end by an outer door 400 having two degrees of freedom for pivoting (e.g., it can pivot about two axes which are substantially perpendicular to each other).

Second end 220 of portal 200 can be in communication with interior 80 of chamber 10, while first end 210 can extend past sidewall 40 (of chamber 10) and be in fluid communication with exterior 85 (or environment).

A portion of body 230 (e.g., second end 220) with the inner door 1400 normally extends into interior 80 of chamber 10 (the interior housing a person at elevated or hyperbaric pressures). A portion of the body 230 (e.g., first end 210) that has outer door 400 normally extends outside of chamber 10. A person inside chamber 10 normally has access to inner door 1400 and can operate door 1400 to open and close the door. However, such person in interior 80 would not have access to handles operating the outer door 400.

Outer Door

On first end 210 can be outer door 400. Door 400 can be rotatably mounted in relation to the shoulder 211. Also on first end 210 can be locking ring 250 which can longitudinally lock in place outer door 400. Locking ring 250 can be attached to first end 210 and include a perimeter groove 290 along with a plurality of unlocking openings 300. In one embodiment the plurality of unlocking openings can be symmetrically spaced about the circumference of locking ring 250.

On second end 220 can be inner door 1400. As will be described below outer door 400 can seal interior 214 from exterior 85 using seal 212. As will be described below inner door 1400 can seal interior 214 from interior 80 of chamber 10 using seal 1422.

Outer door 400 can comprise first end 410, second end 420, along with a plurality of locking projections 500 which detachably lock with locking ring 250. In one embodiment door 400 can include radial projections 510, 520, 530, and 540. More or less locking projections than four can be used.

Outer door 400 can be pivotally connected to portal 200 by support bracket 700, which support bracket can be connected to portal 200 such as by being welded to sidewall 230. In one embodiment outer door 400 can pivot around a vertical axis, such as around hinge 710 (where hinge 710 pivotally attaches to support plate 450 to connection points 720). Such rotation about a vertical axis allows outer door 400 to be opened and closed and provides access to interior 204 In one embodiment outer door 400 can also rotate about a horizontal axis, such as fastener 440. In this manner outer door 400 can both rotate about two axes which are perpendicular to each other (e.g., horizontal axis of fastener 440 which is perpendicular to vertical axis of hinge 710). As shown in FIG. 2, the extent of rotation of outer door 400 about a horizontal axis can be limited. The extent of rotation of outer door 400 about a horizontal axis is limited by the movement of rotation stop 460 within rotation slot 470 (slot 470 being contained in support plate 450 and stop 460 being attached to door 400). Slot 470 setting up a pre-determined arc or rotation for door 400 which arc of door rotation has a length equal to that of the length of slot 470. That is, no further horizontal rotation of outer door 400 can be made once rotation stop 460 hits either end of rotation slot 470. As will be described above the horizontal rotation of outer door 400 allows door to be locked in locking ring and maintain a tight seal against first end 210 of body 230. Also as will be described below rotation slot 460 can be used to rotationally position plurality of locking projections 500 in plurality of unlocking openings 300 of locking ring 250 to allow outer door 400 to detachably lock and unlock in locking ring 250.

Locking of outer door 400 in locking ring is shown in FIGS. 5 and 6. In FIG. 5 outer door 400 is open and in FIG. 6 outer door 400 is closed. When outer door 400 closes, a plurality of projections 500 (510, 520, 530, and 540) enter a plurality of their respective unlocking openings 300 (310, 320, 330, and 340) to allow door 400 to rest in locking ring 250. Stop pin 470 is shown in contact with first end 462 of arcuate slot 460 so that door 400 has been rotated the maximum extent in a counter clockwise direction (schematically shown by arrow 2610 and 2620). At this maximum counter clockwise rotation plurality of projections 500 line up with plurality of unlocking openings 300 and outer door 400 can be shut. However, to shut and seal outer door 400 against body 230, door 400 should be turned in a clockwise direction (in the opposite direction as arrows 2610, 2620). Plurality of projections 500 will enter perimeter groove 290 of locking ring 250.

In a preferred embodiment one or more of plurality of projections 500 can have an upwardly sloping surface so that as outer door 400 is rotated clockwise locking ring 250 pushing on the sloping surfaces will cause door 400 to be pushed tighter against body 230 and energizing the seal between body 230 and door 400. In FIG. 5 sloped surface 512 is schematically shown, however, projections 520, 530, and 540 can each have similar sloped surfaces.

In one embodiment plurality of projections 500 extend diametrically to an extent which is slightly less than the largest diametrical extent of the plurality of unlocking openings 300. This dimensional constraint can prevent outer door 400 from moving out of concentricity even if the center bearing (rotatively connecting door 400 to support bracket 450) wears or if hinge 710 is caused to become misaligned in such a way that a door concentricity error would otherwise be created.

In one embodiment one or more of plurality of projections 500 can have a beveled surface (beveled inwards from first side 410 (facing exterior 85 to second end 420 facing interior 204) so that, as door 400 is pushed closed (i.e., rotated on hinge 710) against body 230, locking ring 250 tends to align door 400 concentrically in relation to interior 204 of body 230. In FIG. 5 beveled surface 514 is schematically shown, however, projections 520, 530, and 540 can each have similar beveled surfaces. That is locking ring 250 radially pushing on the beveled surfaces will cause door 400 to be concentrically aligned in relation to interior 204.

In a preferred embodiment one or more of plurality of projections 500 can have a second radially sloping surface 514' so that, as door 400 is rotated clockwise, locking ring 250 tends to concentrically align door 400 in relation to interior 204 of body 230. That is locking ring 250 radially pushing on the sloping surfaces will cause door 400 to be concentrically aligned in relation to interior 204. In FIG. 5 sloped surface 514 is schematically shown, however, projections 520, 530, and 540 can each have similar sloped surfaces.

Figure 13:
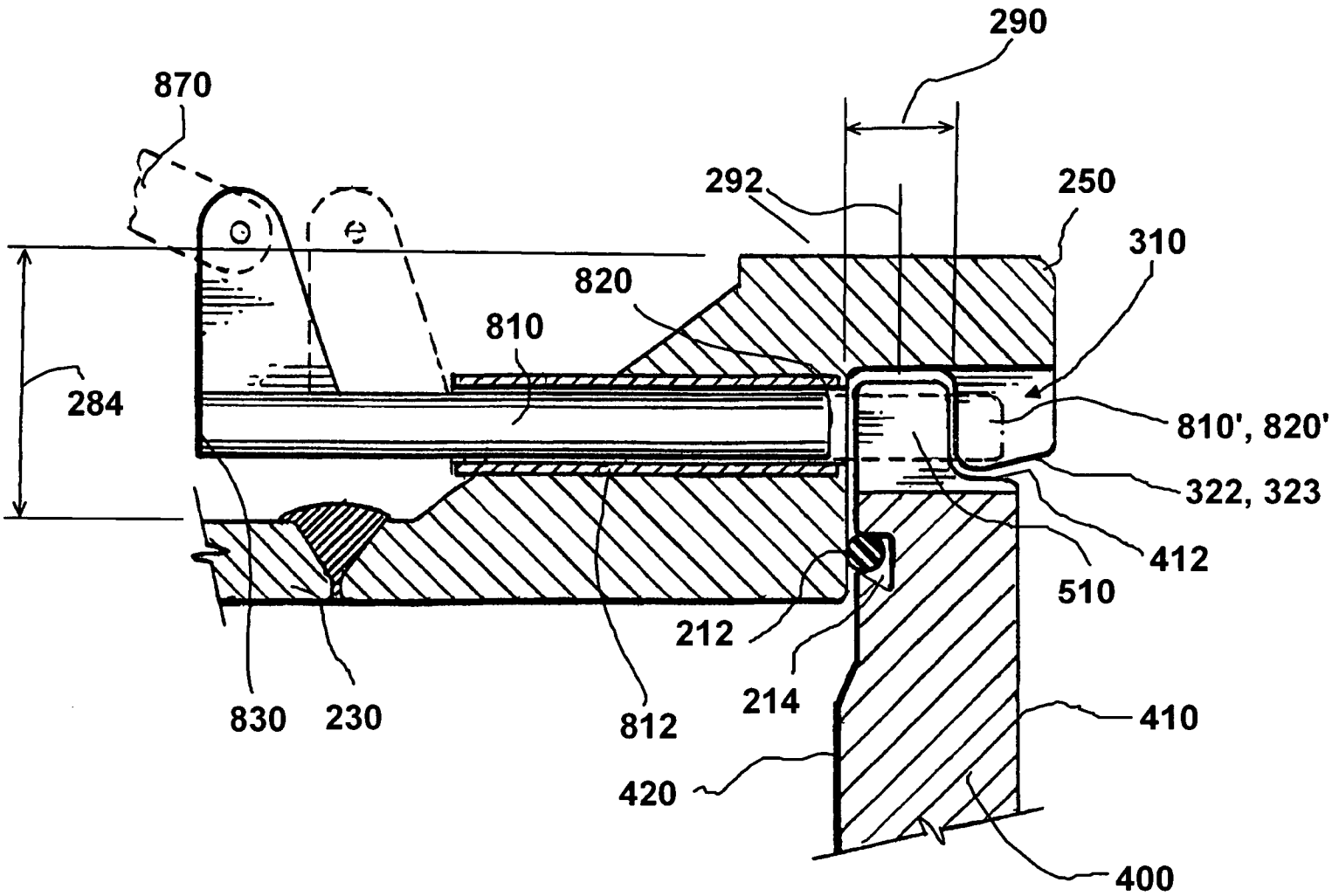
FIG. 13 is a sectional view of the locking member for the quick lock/quick unlock locking system, where it is shown in open and closed states for the locking member, but with an alternative embodiment for the outer door which outer door contains an O-ring and recess for such O-ring.

In certain situations outer door 400 may not be concentric (or may lose concentricity) with respect to locking ring 250 (and body 230). As shown in FIGS. 11 and 13, in one embodiment outer door 400 can include one or more raised sections 412 (which interact with the edges of the locking tabs, such as edge 323 of tab 322) to assist and concentrically aligning inner door 400 with body 230. In one embodiment a single raised section 412 can be provided. Where outer door 400 is out of concentricity, raised section 412 can contact edge 323 (when rotated clockwise) and cause outer door 400 to move into a concentric position. With such adjustment for concentricity, a good seal can be maintained between outer door 400 and body 230 when outer door 400 is closed or shut. This can prevent extrusion of O-ring 212 from groove 214.

In one embodiment a seal can be included between outer door 400 and body 230. In one embodiment (FIGS. 12, 14, and 15) the seal can be attached to first end 210 of body 230. In one embodiment the seal can be an O-ring 212' is fitted in a dovetail-shaped groove 214' formed in first end 210 of body 230. In another embodiment (which is shown in FIG. 13) the O-ring 212 can be placed in a groove 214 on door 400. To prevent O-ring 212 from falling out of the groove 214 when outer door 400 is open, the upper portion of groove 214 can be smaller than the lower portion of groove 214. O-ring 212 can be sized to be 1½ percent smaller than the theoretical size of groove 214 so that the O-ring remains in groove 214 when door 400 is opened.

Outer door 400 can be provided with a pair of handles 600, 610 extending from an outside surface thereof. Handles 600, 610 allow the user to pivot door 400 about a central axis when quick lock/quick unlock 800 and lock 1000 are in unlocked states. Door 400 can be rotatively attached to support bracket 450.

Quick Lock/Quick Unlock

Figure 12:
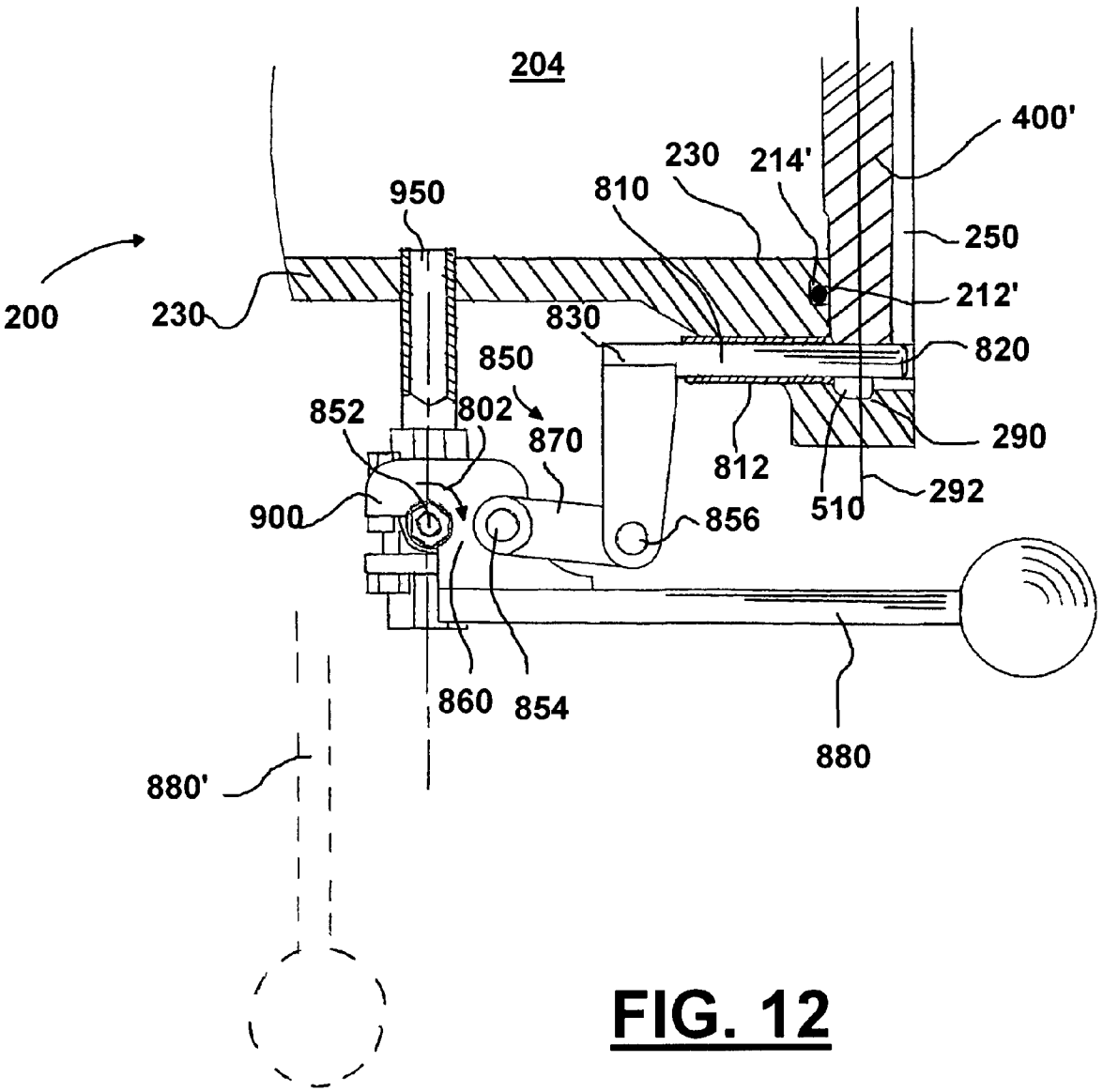
FIG. 12 is a sectional diagram showing the quick lock/quick unlock locking system, along with closed and open states of the handle for this locking system.

FIG. 12 is a sectional diagram showing quick lock/quick unlock 800 system, along with closed 880 and open states 880' of handle 880 for this locking system.

FIG. 13 is a sectional view of locking member 810 for quick lock/quick unlock 800 showing open (position of first end 820) and closed (position of first end 820') states for locking member 810, showing door 400 where O-ring 212' and O-ring recess 214 are located in outer door 400. As will be described below for inner door 1400 placing the seal in the door can make it easier to correct/fix problems with the groove 214' for O-ring 212'.

A quick lock/quick unlock 800 can be operatively attached to portal 200 and set up locked and unlocked states for outer door 400. Generally, quick lock/quick unlock 800 can comprise locking bar 810 operatively connected to valve 900 such that when valve 900 is opened locking bar 810 moves into an unlocked stated, and when valve 900 is closed, locking bar 810 moves into a locked state. Valve 900 can be secured to sidewall 240 and fluidly connect interior 204 of portal 200 with exterior 85. Vent tube 950 of valve 900 can fluidly connect valve 900 to interior 204. When opened, valve 900 equalizes pressure between interior 204 of portal 200 and exterior 85 of chamber 10 (which is typically atmospheric or ambient pressure). When closed, valve 900 prevents air flow between interior 204 of portal 200 and exterior thereof.

Handle 880 can be operatively connected to valve 900, and can be used to open and close valve 900, such as by being pivotally attached to valve 900 where rotational movement opens and closes valve 900, such as in a ball valve. Rotation of handle 880 in a first direction can open valve 900. Rotation of handle 880 in the opposite direction as the first direction can close valve 900.

Handle 880 can also be operatively connected to locking bar 810 through linkage 850. Rotation of handle 880 in the first direction can cause locking bar 810 to enter an unlocked state. Rotation of handle 880 in the opposite direction can cause locking bar 810 into a locked state. When in a locked state locking shaft can pass through (between its upper and lower diametric dimensions, and at least past the 50 percent point of its rear depth or from its second end 270 to its first end 260). When in a locked state, locking bar 810 will restrict rotational movement of at least one of the plurality of locking projections 500 of door 400. That is, door 400 can be rotated until one of the plurality of locking projections comes in contact with locking bar 810 at which point further rotational movement of door 400 can be prevented. For example, locking bar 810 can enter unlocking opening 310 and resist counterclockwise rotation of door 400. The extent of clockwise rotation of door 400 is limited by second end 464 of slot 460 coming in contact with rotation stop 470. In this manner the rotation of door (clockwise and counterclockwise) can be limited so that plurality of locking projections 500 remain at least partially in perimeter groove 290 (and not in plurality of unlocking openings 300), and door 400 is kept in a locked state.

Linkage 850 can comprise handle 880, first bar 860, and first bar's 860 pivoting connections between handle 880 and locking bar 810. Locking bar 810 can be slidably connected to locking ring 250. In this manner handle 880, linkage 850, and locking bar 810 can be a special type of four bar system, or a crank and slider configuration. In one embodiment linkage 850 can be configured such that there is a type of dwelling between the beginning rotational movement of handle 880 to open and sliding movement of locking bar 810 to cause locking bar 810 to change into an unlocked state. For example, the pivoting connection between first bar 860 and locking bar 810 can be offset from the pivot point of handle 880 on valve 900 (such as by about 10 degrees) such that initial rotational movement of handle 880 in a first direction tends to cause locking shaft to extend out (in a more locked position) until continued movement of handle 880 in the same rotational direction finally starts to cause locking bar 810 to stroke back an enter an unlocked state. As a result, the initial movement of the handle 880 does not produce an immediate retraction of the locking bar 810 from locking ring 250. When the handle 880 travels to about 90 degree position (shown in FIG. 4) in relation to its original position (shown in FIG. 2) first bar 860 travels about 70-80 degrees.

Locking bar 810 can be pivotally attached to first bar 860, such that rotational movement of handle 880 transfers locking bar 810 from locked (extended) to unlocked (retracted) states. In one embodiment, to resist wear between locking bar 810 and locking ring 250 a wear/lubricating/guide sleeve can be placed in locking ring 250.

Operatively connecting handle 880 to both venting valve 900 and locking bar 810 is beneficial in that locking shaft can only be in an unlocked stated at a time when interior 204 of portal is venting (or has vented) to exterior 85. However, the venting of interior 204 of portal 200 will take a finite (i.e., non-zero) time and there still exists the possibility that an operator will not allow interior 204 to adequately vent, but will immediately attempt to open outer door 400 after opening handle 880 (i.e., when there still is increased pressure in interior 204). If this were to happen the increased pressure in interior 204 could provide a force (the difference between [interior 204 pressure and pressure of the exterior] times the cross sectional area of interior 204) which can cause door 400 to swing out quickly and harm the operator. Because of this risk of operator attempting to open door 400 while interior 204 has not adequately vented, a second pressure actuated lock can be provided.

Safety Pressure Lock

FIG. 14 is a sectional view of the second or safety lock 1000 system which is pressure sensitive and which is shown in a locked state. FIG. 15 is a sectional view of second or safety lock 1000 system which is pressure sensitive and which is shown in an unlocked state.

An independent safety lock 1000 can be provided for outer door 400. Safety lock 1000 can have a locking motion similar to quick lock/quick unlock 800 (in that it uses a sliding locking bar 1010 through locking ring 250 which resists rotation of one or more of the plurality of locking projections 500). Safety lock 100 is intended to provide a factor of safety (beyond quick lock/quick unlock 800) to avoid outer door 400 being opened where a high pressure is still found in interior 204 of portal 200.

Safety lock 1000 can have locked and unlocked states which states are dependent at least in part on the pressure of interior 204 of portal 200. In one embodiment safety lock 1000 which will generally enter an unlocked state when the difference between interior 204 pressure of portal 200 and exterior 85 is below a specified safety pressure level. In one embodiment the acceptable differential unlocking pressure is less than or equal to about 5 psi, 4 psi, 3 psi, 2 psi, and/or 1 psi. In various embodiments ranges between any of the above referenced pressure differentials are envisioned.

Safety lock 1000 can also enter an unlocked mode in a time delayed fashion compared to the start of venting of interior 204 of portal 200. This time delay can provide an additional factor of safety to allow an adequate quantity of excess pressure in interior 204 to be vented before outer door 400 can be opened. In one embodiment safety lock 1000 will generally take between 10, 15, 20, 25, 30, 35, 40, 45, 50, 55, and 60 seconds to enter an unlocked stated from the start of venting of interior 200 and the time the safety lock 1000 enters the unlocked state.

Safety lock 1000 can comprise locking bar 1010 which is operatively connected to piston/cylinder system 1100. Piston/cylinder system 1100 can be fluidly connected to interior 204 of portal 200 via connecting tube 1160. Piston/cylinder system 1100 can include cylinder 1110 having first end 1120 and second end 1130. Cylinder 1100 can include first end 1120 and second end 1130. On second end 1130 can be a cap 1132 which can be detachably connected to cylinder 1100 (such as by threads). Cap 1132 can be sealed with a seal such as O-ring 1134. The interior 1140 of cylinder 1100 can be fluidly connected to interior 204 of portal through connecting tube 1160. A restriction (such as valve 1170) can be used to restrict or slow down gas flow between interior 204 and interior 1140. In one embodiment an adjustable restrictor is used which can change the amount of restriction to gas flow. For example, valve 1170 can be partially closed limiting the quantity per unit time of gas flow. As another example the internal size of tube 1160 can be sized to limit the quantity per unit time of gas flow. As another example, flow weirs/baffles can be used to restrict/slow gas flow.

Slidably connected to cylinder 1110 can be piston 1200. Piston 1200 can have first end 1210, and second end 1220. First end 1210 can be detachably connected to locking bar 1010 (such as through a fastener which may be threaded). Second end 1220 can include an enlarged base and seal 1230 (which can be an o-ring).

Between second end 1220 of piston 1200 and first end 1120 of cylinder 1100 can be a biasing member 1150 (such as a helical spring) which tends to push piston towards second end 1130 of cylinder (schematically shown in FIG. 15 by arrow 2610).

Where interior 204 has a pressure Pc which exceeds a specified amount, such high pressure can be transmitted through tube 1160 to push against enlarged base at second end 1220 of piston 1200, overcoming the resistance of biasing member 1150, and pushing piston 1200 up (in the opposition direction of arrow 2610). Because piston 1200 is attached to locking rod 1010, such upward movement of piston 1200 will also move up locking rod 1010. The amount of excess pressure needed to push up piston 1200 will be a function of the cross sectional areas of enlarged base along with the resistance of biasing member 1150 (which is a function of its spring constant), frictional forces, along with the ambient pressure (which can enter interior 1140 of cylinder 1100 at first end 1120 at opening 1124 as this opening is not sealed). Alternatively, a weep hole can be placed on first end 1120 of piston.

When interior 204 is pressurized, locking rod 1010 will be in a locked state. This is because the interior 204 pressure Pc overcomes the resisting forces of movement of piston 1200 and pushes up (movement in the opposite direction of arrow 2610) locking bar 1010.

Movement of locking rod 1010 in the opposite direction of arrow 2610 causes locking bar 1010 to enter a locked state. When in a locked state locking bar 1010 can pass through locking ring 250 (between its upper and lower diametric dimensions, and at least past the 50 percent point of its rear depth or from its second end 270 to its first end 260). When in a locked state, locking bar 1010 will restrict rotational movement of at least one of the plurality of locking projections 500 of door 400. That is, door 400 can be rotated until one of the plurality of locking projections comes in contact with locking bar 1010 at which point further rotational movement of door 400 can be prevented. For example, locking bar 1010 can enter unlocking opening 340 and resist counterclockwise rotation of door 400. The extent of clockwise rotation of door 400 is limited by second end 464 of slot 460 coming in contact with rotation stop 470. In this manner the rotation of door (clockwise and counterclockwise) can be limited so that plurality of locking projections 500 remain at least partially in perimeter groove 290 (and not in plurality of unlocking openings 300), and door 400 is kept in a locked state at least until locking shaft enters an unlocked state.

However, when interior 204 is vented to atmosphere (exterior 80), such as when valve 900 is opened by handle 880, the elevated pressure Pc which had previously pushed up piston 1200, will gradually reduce. When Pc in interior 204 is reduced, pressure Pv in the interior 1140 of cylinder will gradually bleed into interior 204 of portal 200. As described above this bleeding process can be slowed down by restrictions to slow down the bleeding process. As the pressure Pv decreases biasing member 1150 will push down (in the direction of arrow 2610) piston 1200. Such downward movement of piston 1200 will cause a downward movement (in the direction of arrow 2510) of locking bar 1010. Locking shaft will eventually move down a sufficient extent to enter an unlocked state. Because the timing of locking bar 1010 entering an unlocked state is delayed and/or because locking bar 1010 entering an unlocked state occurs only when the differential pressure between interior 204 of portal 200 and exterior 85, safety lock provides an additional factor of safety to prevent operators from opening outer door 400 before interior 204 has been adequately depressurized.

When both quick lock/quick unlock 800 and safety lock 1000 are in unlocked states, outer door 400 can be opened by clockwise rotation (to align plurality of locking projections 500 with plurality of openings 300) and then swinging out outer door 400.

Inner Door

Figure 16:
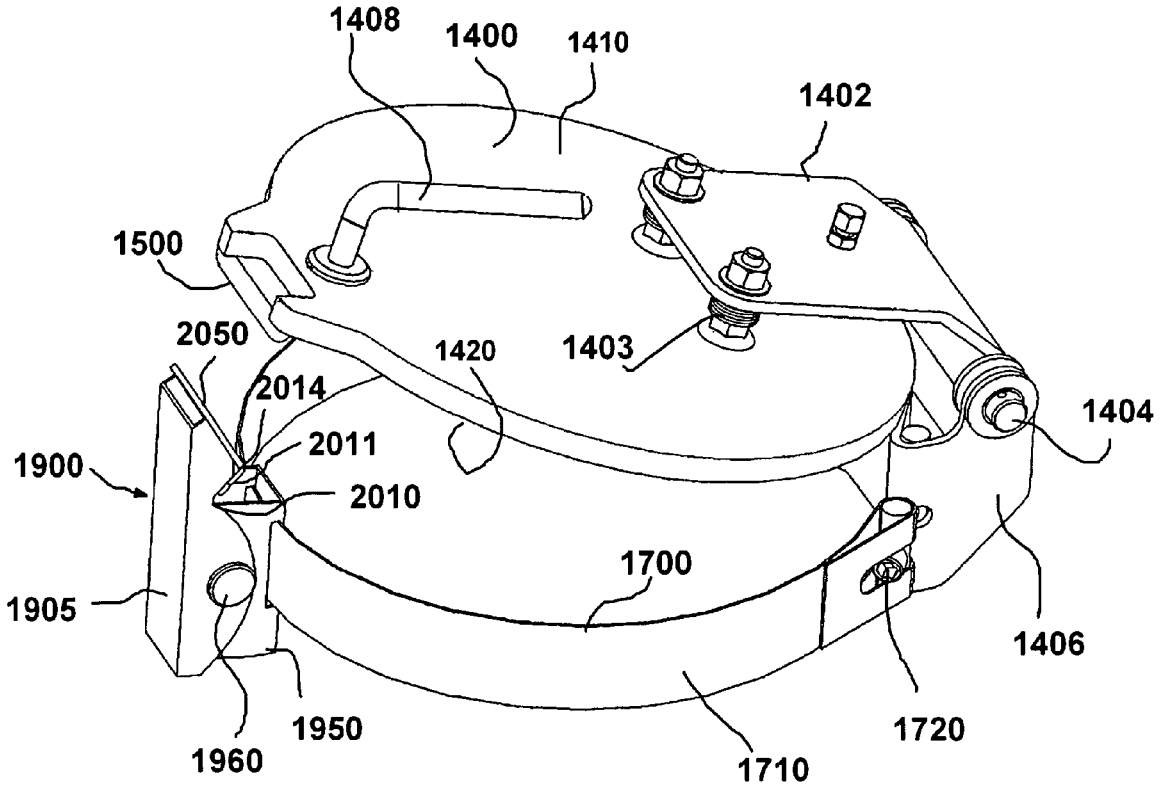
FIG. 16 is a perspective view of the interior door shown not connected to the portal with the door in an open state.
Figure 17:
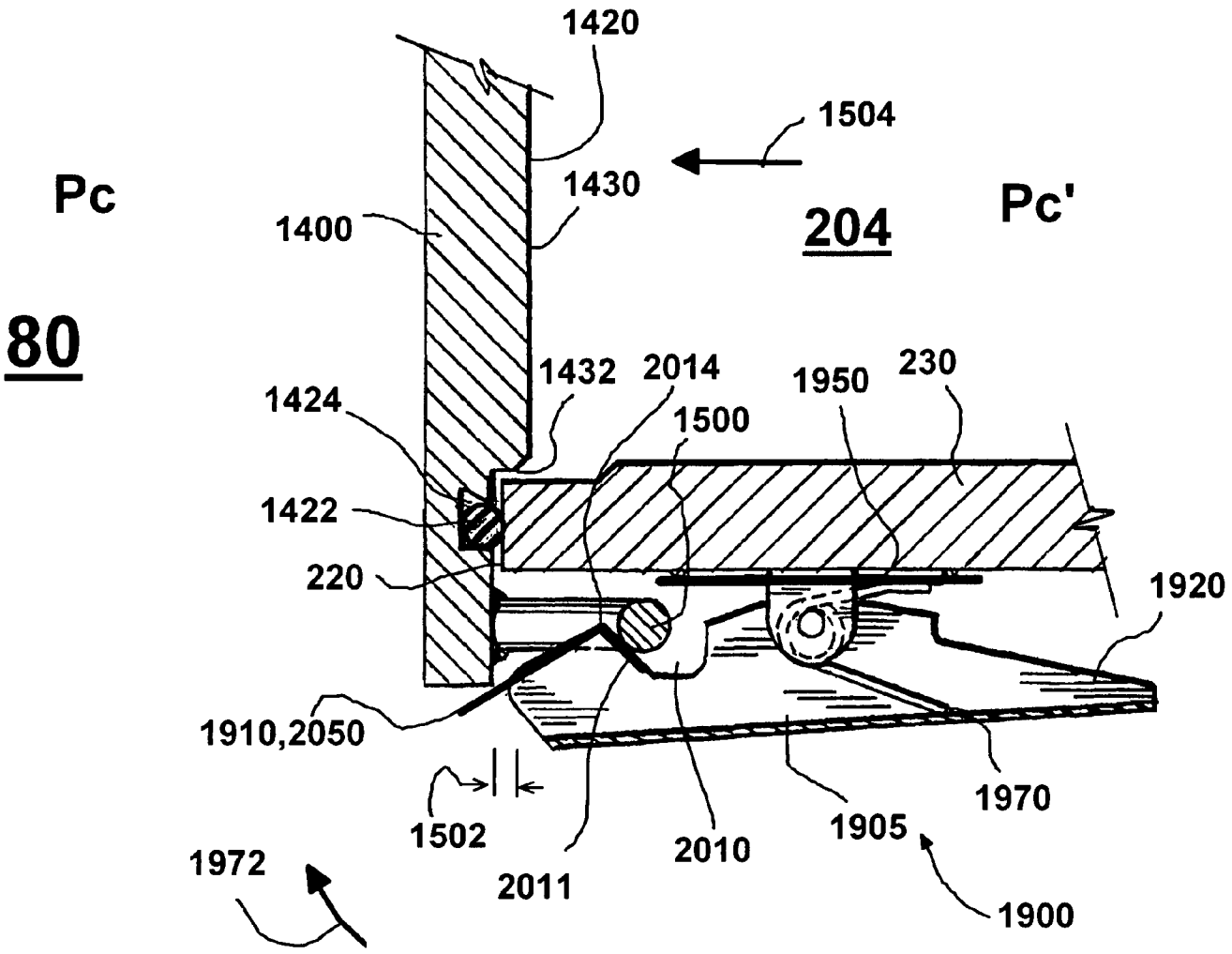
FIG. 17 is a sectional view of the latching system for the inner door shown in a locked state but where there is not a pressure differential between the interior of the dive chamber and the interior of the portal.
Figure 18:
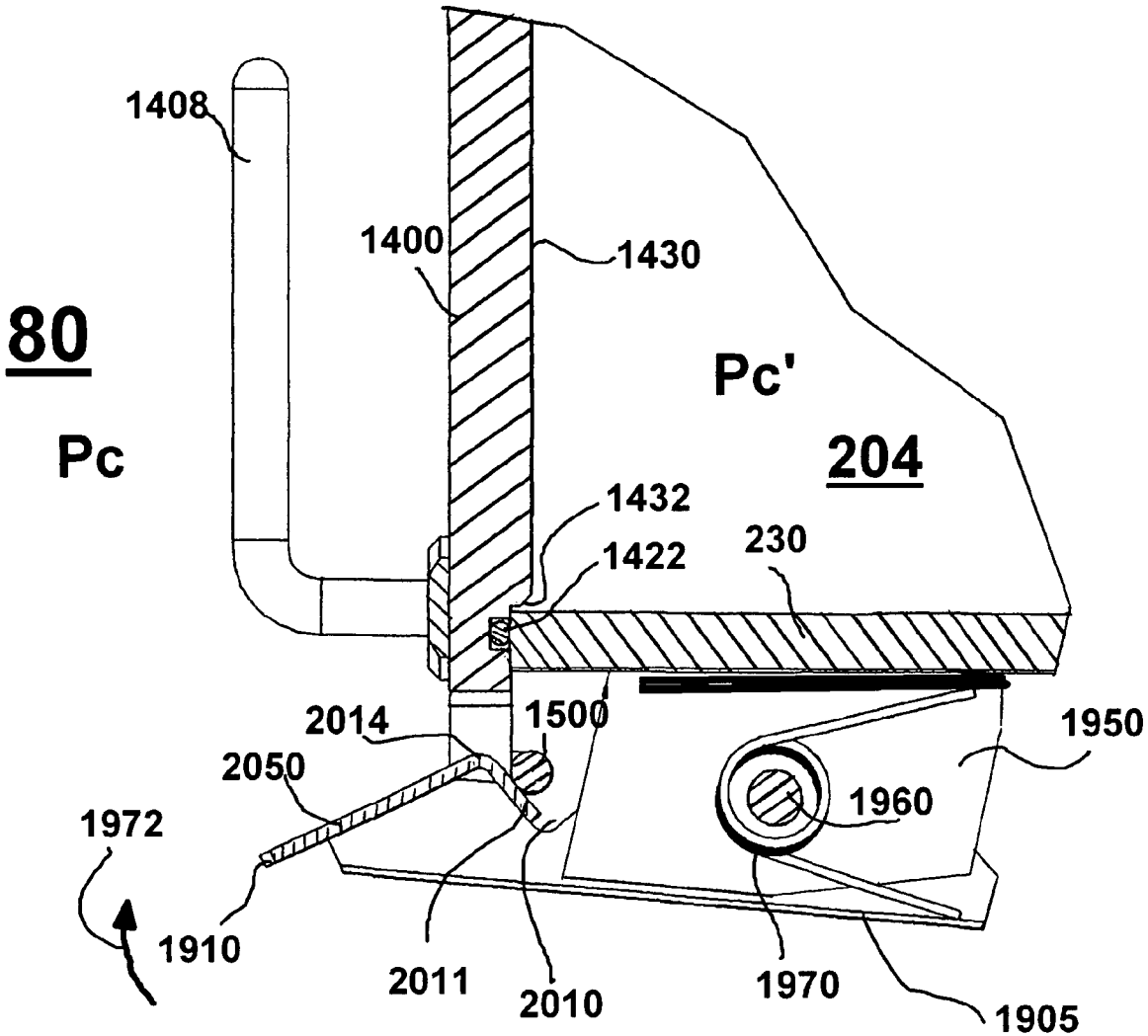
FIG. 18 is a sectional view of the latching system for the inner door shown in a locked state but where the interior pressure of the dive chamber is higher than the interior pressure of the portal, and the inner door is pressed closed based on the force of the larger interior dive chamber pressure.
Figure 19:
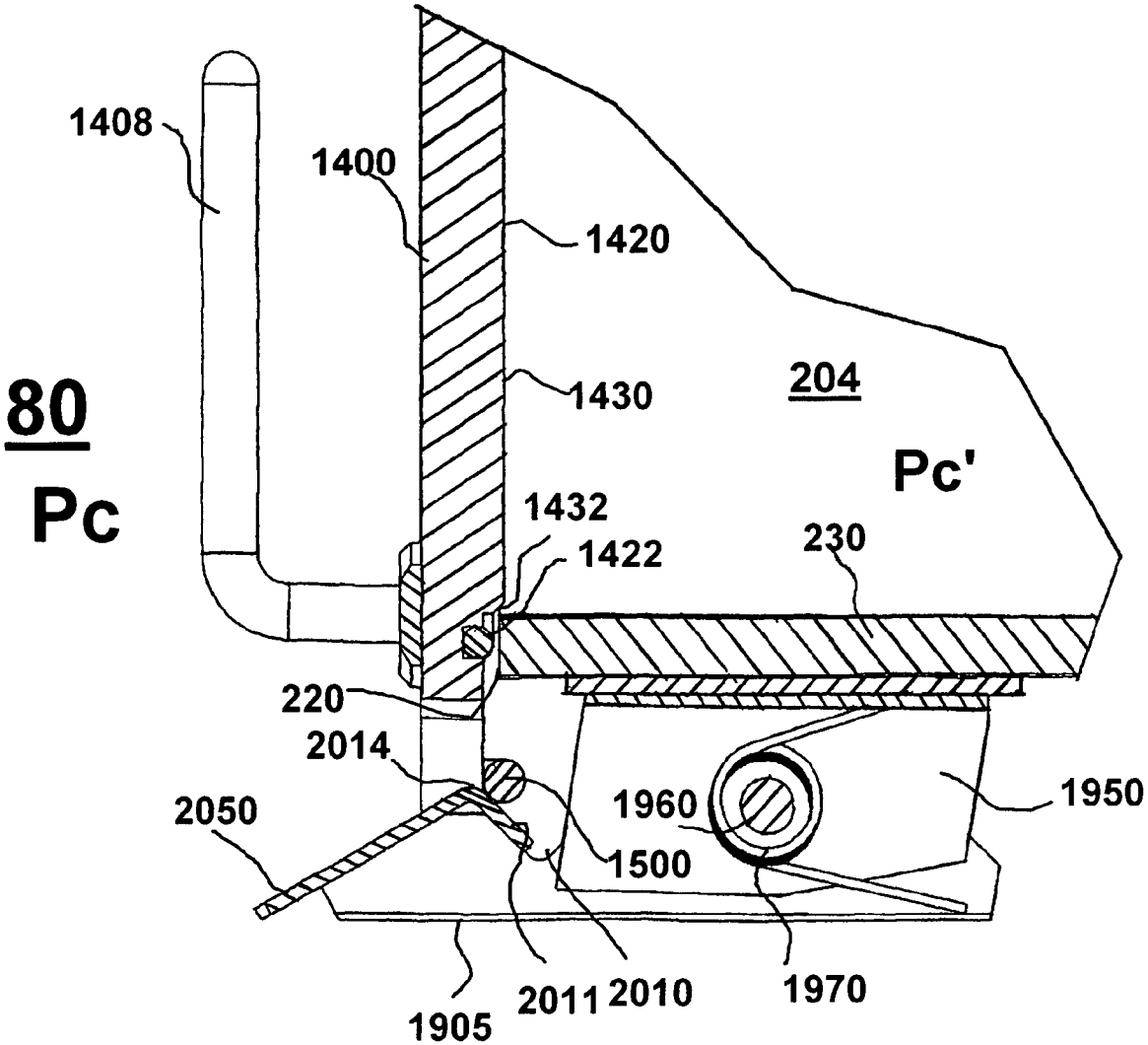
FIG. 19 is a sectional view of the latching system for the inner door shown in a locked state, but where there is not a pressure differential between the interior of the dive chamber and the interior of the portal
Figure 20:
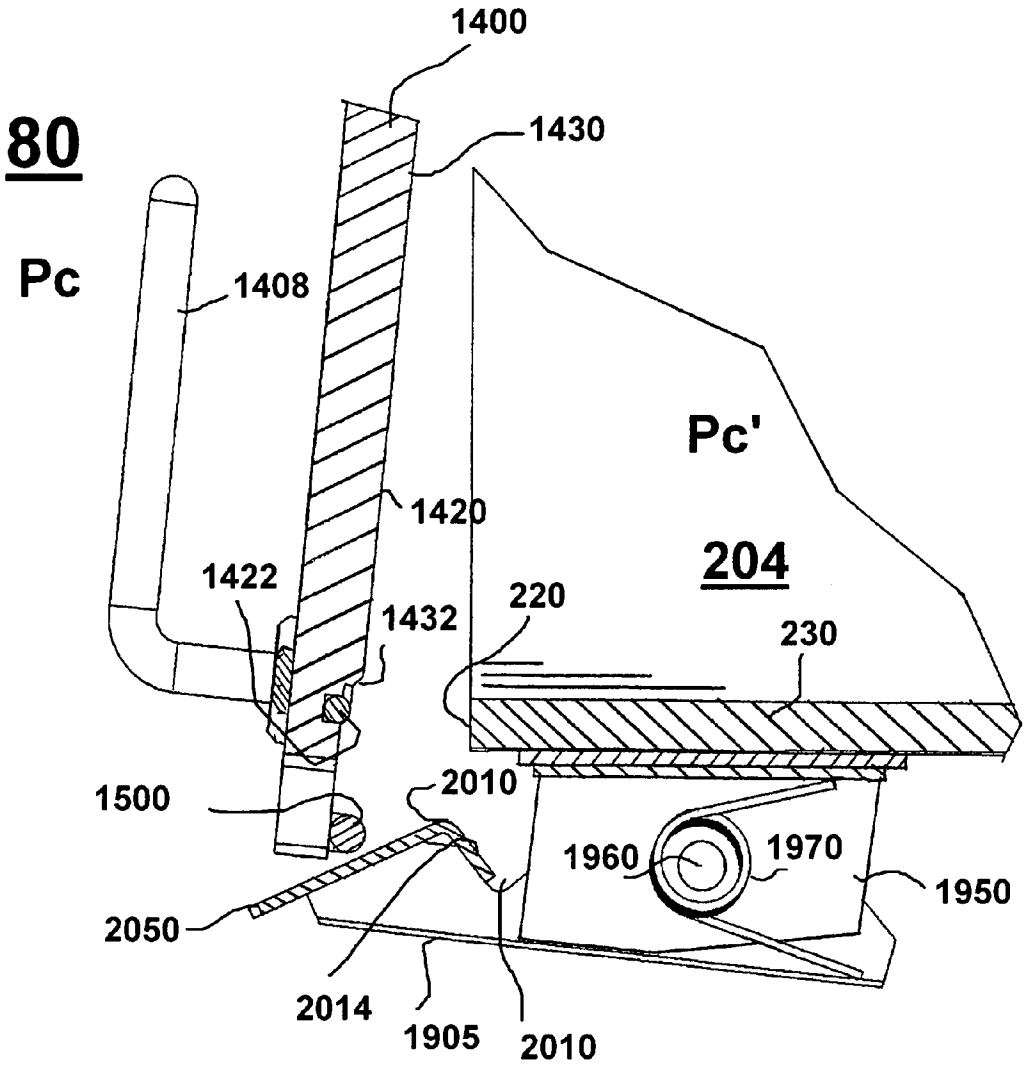
FIG. 20 is a sectional view of the latching system for the inner door shown in an unlocked or open state where the interior door is opened.

Turning now to FIGS. 16-20, inner door 1400 will be described in more detail. FIG. 16 is a perspective view of interior door 1400 shown not connected to portal 200 with door 1400 and where the door is in an open state. FIG. 17 is a sectional view of latching system 1900 for inner door 1400 where the latching system is shown in a locked state, but where there is not a pressure differential between interior 80 of dive chamber 10 and interior 204 of portal 200 (or where interior 204 pressure Pc' is higher than interior 80 pressure Pc). FIG. 18 is a sectional view of latching system 1900 shown in a locked state, but where interior 80 pressure Pc of dive chamber 10 is higher than interior 204 pressure Pc' of portal 200 (and inner door 1400 is forced closed against portal 200 body 230 based on the larger interior 80 dive chamber 10 pressure Pc). FIG. 19 is a sectional view of latching system 1900 shown in a locked state but where there is not a pressure differential between interior 80 of dive chamber 10 and interior 204 of portal 200. FIG. 20 is a sectional view of latching system 1900 shown in an unlocked state and where interior door 1400 is opened.

As can be seen in the drawings, inner door 1400 can be mounted for pivotal movement in relation to the body 230 between (a) an open position, (b) a closed-sealed position, and (c) a plurality of partially open/closed positions. Inner door 1400 can be connected to support bracket 1402, which bracket is secured to a hinge or pivot axle 1404 of base 1406.

Although not shown, hinge 1404 can be attached to a base 1406, which base can be welded to body 230.

Alternatively, hinge 1404 can be secured to an adjustable connecting strap 1700. Connecting strap 1700 can be adjustable and detachably connectable to second end 220 of portal 200. Adjustability of connecting strap 1700 can be obtained through use of a connecting band secured to base 1404 through one or two adjustment mechanisms 1720 (such as threaded fasteners). As adjustment mechanisms are tightened band 1710 tightens around body 230 and a frictional connection is obtained.

Inner door 1400 itself can be adjustable concentrically by using a floating connection 1403 between door 1400 and support bracket 1402.

Handle 1408 can be attached to the outside surface of door 1400.

Opposite hinge 1404 can be a latch 1900. Latch 1900 can comprise body 1905, base 1950, and body 1905 can be pivotally connected to base 1950. Body 1905 can include first end 1910, second end 1920, base 1950, locking cavity 2010, and locking tip 2000. Body 1905 can be pivotally biased to a closed position by spring 1970 (which can be a torsional spring wrapped around pivot point or pin 1960), which biasing is schematically indicated by arrow 1972. In one embodiment locking cavity 2010 can detachably lock connecting bar 1500 of inner door 1400 where spring 1970 normally urges body 1905 into a closed position. Locking cavity 2010 can engage connecting member 1500, and can have a generally hook-shaped configuration for engaging connecting member 1500.

Outwardly sloped portion preferably forms an approximately 30 degree angle in relation to arrow 1504 when body 1905 is fully rotated in the direction of arrow 1972. Upwardly sloped or curved section 2011 preferably forms a relatively small angle from the direction of arrow 1972, approximately 45 degrees when body 1905 is fully latched onto connecting member 1500.

The size and shape of locking cavity 2010 can be made to retain inner door 1400 in a normally closed position. An O-ring 1422 can be positioned in a groove 1424 formed on second end 1420 of door 1400. O-ring 1422 can be fitted in a dovetail-shaped groove 1424 formed on second end (inner surface) 1420 of inner door 1400. O-ring 1422 seals door 1400 against an edge of body 230 when door 1400 is closed.

In one embodiment, even when body 1905 of latch 1900 is fully rotated in the direction of arrow 1972, locking cavity 2010 continues to allow a limited extent of possible vertical movement of connecting member 1500 (i.e., there will be a limited amount of play). This extent of possible vertical movement or play is schematically indicate d by arrows 1502. Alternatively, an extent of possible vertical movement of connecting bar 1500 can be allowed by base 1905 giving way (e.g., rotating in a direction opposite to arrow 1972) a certain extent when a force in the direction of arrow 1504 is applied) on inner door 1400 (such as by a differentially higher pressure in interior 204 compared to interior 80), but while base 1905 remains latched and resisting (albeit partially) movement of connecting bar 1500. The force on inner door 1400 will be transferred to connecting member 1500, and then transferred to body 1905 causing body 1905 to rotate at least partially in the opposite direction of arrow 1972 (however, spring 1970 will continue to maintain a torsional force on body 1905 tending to make body 1905 want to rotate in the direction of arrow 1972). In this manner spring 1970 and latch body 1905 can allow inner door 1400 to slightly open, breaking the seal and venting the differentially higher interior 204 pressure to interior 80 without ever setting up a situation where an explosive differentially higher interior 204 pressure can be seen. After the pressure vents, body 1905 will pull door 1400 closed again. Once the interior 204, 80 pressures equalize, inner door 1400 will again be pushed in the opposite direction of arrow 1504 by spring 1970 rotating body 1905 in the direction of arrow 1972 causing locking cavity 2010 to pull down connecting member 1500.

This extent of possible vertical movement is envisioned to allow a break in the seal between O-ring 1422 and body 230 so that an increased pressure (relative to interior 80) in the interior 204 of portal 200 can vent into interior 80 of chamber 10 and not risk an excessive pushing force in the direction of arrow 1504 on inner door 1400. In one embodiment, locking cavity 2010 can include an upwardly sloped or curved section 2011 so that an differential increase in the pressure in interior 204 (relative to interior 80) tends to push inner door 1400 in the direction of arrow 1504, which tends to push connecting member 1500 in the same direction. Movement of connecting member 1500 in the direction of arrow 1504, by contact with section 2011, will tend to cause body 1905 to rotate in the opposite direction of arrow 1972, and allow inner door 1400 to move slightly in the direction of arrow 1504—at least until a seal of O-ring 1422 between inner door 1400 and body 230 is broken and interior 204 starts to vent into interior 80. In this way only a relatively small incremental increase in pressure of interior 204 of portal 200 relative to interior 80 of vessel 10 is allowed (before venting to interior 80 starts) thereby decreasing the risk that a relatively large incremental increased pressure of interior 204 relative to interior 80 will be set up—which large pressure differential could "swing out hard" inner door 1400 and harm someone.

In one embodiment the extent of possible differential (e.g., outward or vertical) movement between inner door 1400 and body 230 can be less than about 5, 4, 3, 2, 1, ½, ¼, ⅛, 1/10, 1/20, 1/30, 1/40, 1/50, 1/60, 1/70, 1/80, 1/90, 1/100, and/or 1/200 millimeters. In one embodiment the extent of possible differential movement can be limited to the "flexing" size differential allowed by O-ring 1422. In one embodiment the extent of possible vertical movement of the door is limited to an extent to where the sealing O-ring is between about 50 percent 1 percent compressed, 40 and 1, 30 and 1, 25 and 1, 20 and 1, 15 and 1, 10 and 1, and 5 and 1. In one embodiment the extent of possible vertical movement of the door is limited to an extent to where the sealing O-ring is between about 50 percent 5 percent compressed, 40 and 5, 30 and 5, 25 and 5, 20 and 5, 15 and 5, 10 and 5, and 5 and 2. In various embodiments ranges between any two of the above specified possible ranges can be limited for O-ring compression.

A limit on the extent of possible vertical movement will allow inner door 1400 to be transported in a "closed" position, but limit the swinging back and forth of inner door 1400 differential movements (or jerking movements) during transportation. Additionally, a limit on the extent of possible vertical movement can resist banging open and shut inner door 1400 relative to body 230 when in use, such as by jerking caused by wave movement on a ship on which chamber 10 is installed. Preferably, the limit of vertical movement is the "flexing" of O-ring 1422 because then O-ring 1422 can also reduce the amount of banging because the polymer composition of O-ring 1422 softens/dampens the shutting of door 1400 by resisting movement. Even where the limited amount of vertical movement is larger than the flexing extent of O-ring, when inner door 1400 starts to come in contact with body 230, O-ring can contact first and start to soften (or even prevent) metal to metal contact between inner door 1400 and body 230 (which reduces or prevents banging of inner door).

In closing inner door 1400, handle 1408 can be used to move door 1400 in the opposite direction of arrow 1972 until connecting member 1500 contacts outwardly sloped portion 2050 of body 1905. As door 1400 is continued to be pushed closed the force of spring 1970 is overcome and body 1905 rotates in the opposite direction as arrow 1972, at least until point 2014 is reached. As door is continued to be pushed closed in the opposite direction as arrow 1504, spring 1970 causes body to rotate in the direction of arrow 1972 and connecting member 1500 to be "locked" inside of locking cavity 2010.

Where interior 80 pressure in chamber 10 is greater than interior 204 pressure, such differential higher pressure relative to interior 204 of portal 200 tends to push against (create a force pushing) inner door 1400 (in the direction opposite to arrow 1504) causing inner door 1400 will seal against body 230 with O-ring 1422. A seal between interior 80 and interior 204 can be maintained by O-ring 1424 because the higher interior 80 pressure pushes door 1400 against body 230 energizing the sealing effect of O-ring 1424 between door 1400 and body 230.

To open inner door handle 1408 can be used to swing inner door 1400 in the direction of arrow 1972. Connecting member 1500 will contact section 2011 and push up/push out section 2011 causing body 1905 to rotate in the opposite direction of arrow 1972, allowing inner door 1400 to continue to move in the direction of arrow 1504 and pass point 2014 which is maximum extent of upwardly sloped section 2011. After this point inner door 1400 can be opened completely. Once connecting member 1500 passes point 2014, spring 1960 will cause body 1905 to rotate in the direction of arrow 1972.

Alternatively, outwardly sloped portion 2050 can be used by the person in the interior to manually push body 1905 in the opposite direction of arrow 1972, such as by using the person's thumb to push on portion 2050 at the same time as pulling up on handle 1408. If the user wishes to open the door 1400, the user will push on outwardly sloped portion 2050, causing latch body 1905 to pivot away (rotate in a direction opposite of arrow 1972) from the connecting member 1500, thereby allowing door 1400 to be pivoted into an open position.

In the event that an increased pressure of the interior 204 (relative to the interior 80) exists which is not enough to start venting interior 204 by itself, a type of manual venting occurs before latch 1900 is unlocked. That is, as handle 1408 is pulled upwardly in the direction of arrow 1504, door 1400 will also start to move in this direction and the seal of O-ring 1422 (between door 1400 and body 230) will break and venting will start to occur even before connecting member 1500 comes out of locking cavity 2010. Here, while it continues to remain in locking cavity 2010, inner door 1400 remains "locked" but allows venting to occur before inner door 1400 is completely released by latch 1900.

In one embodiment, handle 1408 can be located above upwardly sloped or curved section 2011 so that section 2011 can be "thumb-pressed" to manually release connecting member 1500 from locking cavity 2010. Such a positioning also prevents finger pinching by the latch.

In certain situations inner door 1400 may not be concentric (or may lose concentricity) with respect to body 230. In one embodiment inner door 1400 can include one or more guides to assist and concentrically aligning inner door 1400 with body 230. In one embodiment a raised center 1430 with angled portion 1432 can be provided. Where inner door 1400 is out of concentricity, angled portion 1432 can contact body 230 and cause inner door 1400 to move into a concentric position. In one embodiment this process of being aligned concentrically is facilitated by inner door 1400 being connected to support bracket 1402 with a floating connection 1403. Floating connection, although it maintains a nominal concentric position of inner door 1400 with respect to support bracket 1402, inner door 1400 can move position relative to support bracket, and such relative movement can adjust the concentricity of inner door 1400 relative to body 230. With such adjustment for concentricity, a good seal can be maintained between inner door 1400 and body 230 when inner door 1400 is closed or shut.

In one embodiment latch 1900 holds inner door 1400 "securely closed" during shipment, but yet allows (during use) inner door 1400 to temporarily (and/or partially) lift off of the seal (O-ring 1422) and "vent" any differential increase in pressure which may exist in portal 200 (or decrease in pressure in chamber 10). In the event of a pressure differential attempting to open inner door 1400, latch 1900 allows door 1400 to "lift off" of the seal to vent the pressure. However, when the differential pressure has been equalized (by the venting), spring 1970 and sloping contact surface 2011 of locking cavity 2010 pull door 1400 "closed" again.

In one embodiment latch 1900 also allows door 1400 to be closed without manually depressing latch body 1905 (e.g., pushing on outwardly sloped portion 2050) because the angle of sloped portion 2050 combined with the spring action (of spring 1970 on body 1905) allow body to first rotate in the opposite direction of arrow 1972 (to open latch 1900) and then snap back in the direction of arrow 1972 against connecting member 1500 when door 1400 is pressed closed.

In one embodiment O-ring 1422 and groove 1424 are placed in inner door 1400. Conventional methods for sealing provide for the O-ring and groove to be placed in the non-moving portion of a door/closure seal (and not the moving door). The disadvantage of this solution can be seen where the O-ring groove becomes damaged requiring machining to repair. If O-ring groove 1424 was placed in the end of body 230 and became damaged, the entire chamber 10 would need to be taken out of service so that body 230 could be re-machined (possibly requiring the cutting out of body 230 from chamber 10); or a very expensive in-place machining operation must be performed if it is available. Placing O-ring 1422 and groove 1424 in inner door 1400 minimizes the possibility that expensive machining on body 230 will have to be done in place. First, the sealing face (location where seal occurs between door 1400 and body 230) on the end body 12 is now merely flat. A flat surface is less likely to become damaged, and, if damaged, such flat surface can be repaired using inexpensive manual methods (e.g.,—a hand file). Furthermore, O-ring groove 1424 can now be easily repaired because inner door 1400 can be easily removed from portal 200 (and chamber 10) and taken to a machine shop.

Placing O-ring groove 1422 in inner door 1400 creates a condition that must be addressed. If inner door 1400 moves concentrically out of position relative to portal 230, an offset can be created between O-ring groove 1424 and the flat end of body 230 which offset could allow O-ring 1422 to fail in extrusion (such as to interior 204 of portal 200). In one embodiment this risk is addressed by providing a guide on inner door 1400 to assist in concentrically aligning inner door 1400 with body 230. As described above one embodiment of this adjustment guides includes an angled portion on inner door 1400 with the possible use of a floating connection 1403 between door 1400 and support bracket 1402. Another possible solution is to have the end of tube (with the flat sealing surface) widened to compensate for possible eccentric movement of inner door 1400.

Method of Use

FIGS. 1-6 show various steps where portal 200 is used to transmit an item 3000 to an individual located in the interior 80 of chamber 10 while chamber 10 is pressurized. FIG. 1 is a perspective view of decompression chamber 10 with interlocking portal 200. Chamber 10 has first end 20, second end 30, and cylindrical wall 40. Chamber 10 also has an interior 80 which is at an elevated pressure relative to exterior 80. Item 3000 is to be transferred from exterior, through portal 200, and into interior 80 where interior 80 is to remain at an elevated pressure.

FIG. 2 is an enlarged perspective view portal 200 looking at portal 200 from the front 20 of chamber 10, and where a portion of sidewall 40 of chamber 10 has been removed to show the front 210 and rear 220 ends of portal 200. FIG. 3 is an enlarged perspective view of portal 200, but now looking at portal 230 from the rear 30 of chamber and where a portion of the upper section has been removed to reveal interior 204 of the portal 230. Here, interior 204 is shown as being at pressure Pc and interior 80 of chamber is at equal pressure Pc. Exterior 85 of chamber 10 is shown as being at pressure Pa, and Pc is elevated compared to Pa—which is the normal situation for decompression (or hyperbaric) chambers during operation. Outer door 400 is sealed relative to interior 204 pressure Pc, however, elevated pressure Pc will push on outer door 400. Locking ring 250 maintains outer door 400 shut. Outer door 400 can be opened by rotating it in a counterclockwise direction (arrow 2613) to align plurality of locking projections 500 with plurality of unlocking openings 300. However, to prevent an explosive event (i.e., the high pressure Pc causing an explosive opening of door 400) a double safety lock system is provided for outer door 400 which includes quick lock/quick unlock 800 along with second safety lock 1000 and are both in locked states.

FIG. 4 is an enlarged perspective view of portal 230, but showing both quick lock/quick unlock 800 and second safety lock 1000 having moved into "unlocked" states. Here, quick lock/quick unlock 800 has been placed in an unlocked state by pushing handle 880 in the direction of arrow 2504. Handle 880 is operatively connected to first locking bar 810 (through linkage mechanism 850), and turning handle 880 in the direction of arrow 2504 causes bar 810 to slide backward in locking ring 250 so that shaft 880 no longer restricts rotation of locking projection 510. Handle 880 is also operatively connected to valve 900, so that at the same time rotation of handle 880 opens valve 900 which starts the venting process of excess pressure Pc (located inside interior 204 of portal 200) to exterior 80. Inner door 1400 was previously closed (with valve 1600 shut) so that when interior 204 pressure Pc' vents out and decreases, now pressure Pc' becomes less than interior 80 pressure Pc inside chamber 10. Now excess pressure Pc (compared to Pc') pushes on inner door 1400 which energizes O-ring 1422 seal to maintain a seal between interior 80 of chamber 10 and interior 204 of portal 200—so that interior 80 of chamber 10 will not lose (e.g., vent) its elevated pressure Pc. As described above, in a preferred embodiment locking bar 810 experiences a dwell period before it starts it sliding back in relation to rotation of handle 880 to allow vent 900 to first open and at least start venting interior 204 of portal before locking bar 810 enters an unlocked state. Additionally, locking bar 810, when moving from locked to unlocked (and from unlocked to locked) states, respective exits and enters perimeter groove 290 of locking ring 250 (i.e., between the outer edge of locking ring 250 and the outer wall of body 230). Additionally, when moving from an unlocked state to a locked stated locking bar 810 moves away from inner door 1400 towards outer door 400 (and when moving from an unlocked state to a locked state, moves away from outer door 400 towards inner door 1400).

However, even though quick lock/quick unlock 800 may move to an unlocked state, outer door 400 still cannot be opened until safety lock 1000 also moves to an unlocked state. Safety lock 1000 is a pressure based safety lock and time delayed compared to the time in which quick lock/quick unlock 800 is placed in an unlocked state. After quick lock/quick unlock is placed in an unlocked state and interior 204 starts to vent, the interior volume 1140 of piston/cylinder 1100 will start to vent into interior 204 dropping pressure Pv (which before the start of venting of interior 2014 was the same as pressure Pc) allowing spring 1150 to push piston 1200 in the direction of arrow 2610 and move delay locking bar 1010 in the direction of arrow 2510 until delay locking bar 1010 moves to an unlocked state, no longer restricting rotational movement of outer door 400. Additionally, when moving from an unlocked state to a locked stated delay locking bar 1010 moves away from inner door 1400 towards outer door 400 (and when moving from an unlocked state to a locked state, moves away from outer door 400 towards inner door 1400). Accordingly, if for some reason placing quick lock/quick unlock 800 in an unlocked state does not vent interior 204 of portal, safety lock 1000 will remain in a locked state also preventing the opening of door 400. Furthermore, safety lock 1000 is designed such that it can only enter an unlocked state when a certain maximum interior pressure Pc' is reached in interior 204 to prevent door 400 from being opened at a time when interior pressure Pc' can still push and swing door 400 open in a manner which can do harm. This minimum pressure for unlocking can be achieved by using a spring 1150 of a certain stiffness compared to the cross sectional area of second end 1220 of piston 1200. In one embodiment safety lock 1000 which will generally enter an unlocked state when the difference between interior 204 pressure of portal 200 and exterior 85 is below a specified safety pressure level. In one embodiment the acceptable differential unlocking pressure is less than or equal to about 5 psi, 4 psi, 3 psi, 2 psi, and/or 1 psi. In various embodiments ranges between any of the above referenced pressure differentials are envisioned. In one embodiment safety lock 1000 can also enter an unlocked mode in a time delayed fashion compared to the start of venting of interior 204 of portal 200. This time delay can provide an additional factor of safety to allow an adequate quantity of excess pressure in interior 204 to be vented before outer door 400 can be opened. In one embodiment safety lock 1000 will generally take between about 1, 2, 3, 4, 5, 6, 7, 8, 9, 10, 15, 20, 25, 30, 35, 40, 45, 50, 55, and 60 seconds to enter an unlocked stated from the start of venting of interior 200 and the time the safety lock 1000 enters the unlocked state. A time delay can be obtained by providing a restriction/limiter to flow out of volume 1140 to interior 204.

Once both quick lock/quick unlock 800 and safety lock 1000 have entered unlocked states, outer door 400 can be opened providing access to interior 204. Because interior 204 has been fully vented to exterior 80 (through valve 900), interior 204 pressure Pc' is now equal to exterior 85 pressure Pa. Door 400 can be opened by rotating it counterclockwise and then pulling it open. The seal between inner door 1400 and body 230 prevents venting from interior 80 of chamber to the outside. FIG. 5 is an enlarged perspective view of portal 200 with outer door 400 opened and schematically showing an item 3000 being placed (arrow 3010) in the interior 204 of the portal 230. Now that item 3000 has been placed in the interior 204, outer door 400 can be closed. FIG. 6 is an enlarged perspective view of portal 200 showing item 3000 placed in portal 200 with outer door 400 closed and both quick lock/quick unlock 800 and safety lock 100 having been moved into locked states. Outer door 400 is shut by swinging it closed and turning it clockwise (in the direction of arrows 2612 and 2622) using handles 600, 610. Quick lock/quick unlock 800 is placed in a locked state by pushing handle in the direction of arrow 2506 which both slides locking bar 810 in a locked state (restricting counterclockwise rotation of door 400), and closes valve 900 (sealing interior 204 from exterior 85 as outer door 400 is sealed with respect to body 230 by O-ring 212). Interior 204 has remained sealed from interior 80 of chamber because inner door 400 has continually been pushed shut because of higher interior 80 pressure Pc compared to interior 204 pressure Pc' (which is equal to exterior 85 pressure Pa). To allow access from interior 80 to interior 204, inner door 400 must be opened. This can be done by venting interior 80 pressure Pc into interior 204—by opening valve 1600. Arrows 1650 schematically indicate the venting of interior 80 pressure into interior 204 through vent opening. As this venting occurs (between interiors 80 and 204) the interior 204 pressure Pc' will gradually rise to equal interior 80 pressure Pc and no longer will there be a closing force on inner door 1400. Also as this venting occurs, the rising interior 204 pressure will cause safety lock 1000 to move into a locked state as pressure also vents into the piston/cylinder 1100 causing piston 1200 to extend and locking bar 1010 to move into a locked state.

When interior 204 pressure Pc' equalizes with interior 80 pressure Pc, the individual inside chamber 10 can open latch 1900, open inner door 1400, and remove item 3000. FIG. 7 is an enlarged perspective view of portal 200 showing inner door 1400 being opened (swung in the direction of arrow 1401) and item 3000 being moved from interior 204 of portal 200 to interior 80 of chamber 10 (schematically shown by arrow 3012). Opening latch 1900 is schematically indicated by arrow 2100.

After removal of item 3000, portal 200 can be readied for the next transfer. To do this valve 1600 should be shut, and inner door 1400 should be swung closed (opposite direction as arrow 1401) so that it is latched by latch 1900. At this point interior 204 of portal 200 will be the same pressure Pc' as interior 80 of chamber 80.

To transfer an item 3000 from interior 80 to exterior 85, the first step would have been to have the individual inside chamber 10 place item 3000 in interior 204 of portal 200 and close inner door 1400. Then the steps previously described for opening outer door 400 would be followed for a person outside of chamber 10 to remove item 3000 from inside of portal 200.

When venting from interior 80 of chamber 10 to interior 204 of portal 200 it is not expected that interior 80 of chamber will lose much pressure. This is because the volume of interior 80 of chamber is so much larger than the interior 204 of portal.

The following is a list of reference materials:

LIST FOR REFERENCE NUMERALS

| (Part No.) Reference Numeral | (Description) Description |
|---|---|
| 10 | decompression chamber |
| 20 | first end |
| 30 | second end |
| 40 | wall |
| 50 | base |
| 60 | door |
| 70 | seal |
| 80 | interior |
| 85 | exterior |
| 200 | portal |
| 204 | interior |
| 210 | first end |
| 211 | shoulder |
| 212 | O-ring |
| 214 | O-ring groove |
| 216 | enlarged area |
| 218 | reduced area |
| 220 | second end |
| 230 | body |
| 240 | side wall |
| 250 | locking ring |
| 254 | opening |
| 260 | first end |
| 270 | second end |
| 280 | body |
| 284 | height |
| 290 | perimeter groove |
| 300 | plurality of unlocking openings |
| 310 | first opening |
| 312 | locking tab |
| 313 | edge |
| 320 | second opening |
| 322 | locking tab |
| 323 | edge |
| 330 | third opening |
| 332 | locking tab |
| 333 | edge |
| 340 | fourth opening |
| 342 | locking tab |
| 343 | edge |
| 400 | outer door |
| 410 | first end |
| 412 | extended end |
| 414 | angled beveled end |
| 416 | outer end |
| 418 | inner end |
| 420 | second end |
| 430 | center |
| 440 | fastener |
| 450 | support plate |
| 460 | rotation slot |
| 462 | first end |
| 464 | second end |
| 470 | rotation stop |
| 500 | plurality of locking projections |
| 510 | first projection |
| 512 | sloped surface |
| 514 | beveled surface |
| 520 | second projection |
| 530 | third projection |
| 540 | fourth projection |
| 600 | handle |
| 610 | handle |

-continued

LIST FOR REFERENCE NUMERALS

| (Part No.) Reference Numeral | (Description) Description |
|---|---|
| 700 | support bracket |
| 710 | hinge |
| 720 | connection points |
| 800 | first quick lock |
| 802 | arrow |
| 810 | locking bar |
| 812 | wear/lubrication sleeve |
| 820 | first end |
| 830 | second end |
| 850 | linkage mechanism |
| 852 | pivot point |
| 854 | pivot point |
| 856 | pivot point |
| 860 | first bar |
| 870 | second bar |
| 880 | handle |
| 900 | valve |
| 910 | first end |
| 920 | second end |
| 950 | vent tube |
| 960 | first end |
| 970 | second end |
| 1000 | second delay lock |
| 1010 | delay locking bar |
| 1012 | wear/lubrication sleeve |
| 1020 | first end |
| 1030 | second end |
| 1050 | linkage mechanism |
| 1100 | piston/cylinder system |
| 1110 | cylinder |
| 1120 | first end |
| 1124 | opening on first end |
| 1130 | second end |
| 1132 | cap |
| 1134 | O-ring |
| 1140 | interior |
| 1150 | biasing member |
| 1160 | connecting tube |
| 1170 | flow control |
| 1172 | arrow |
| 1200 | piston |
| 1210 | first end |
| 1220 | second end |
| 1230 | seal |
| 1400 | inner door |
| 1401 | arrow |
| 1402 | support bracket |
| 1403 | floating connection |
| 1404 | hinge |
| 1406 | base |
| 1408 | handle |
| 1410 | first end |
| 1420 | second end |
| 1422 | O-ring |
| 1424 | O-ring groove |
| 1426 | enlarged area |
| 1428 | reduced area |
| 1430 | raised center |
| 1432 | angled portion |
| 1434 | base |
| 1500 | connecting bar |
| 1502 | arrows |
| 1504 | arrow |
| 1600 | interior venting valve |
| 1610 | handle |
| 1620 | vent opening |
| 1630 | arrow |
| 1640 | arrow |
| 1650 | arrow |
| 1700 | connecting strap |
| 1710 | band |
| 1720 | adjustment mechanism for band |
| 1800 | hinge |
| 1810 | connection points for door |

-continued

| LIST FOR REFERENCE NUMERALS | |
|---|---|
| (Part No.) Reference Numeral | (Description) Description |
| 1900 | latch or quick lock for inner door |
| 1905 | body |
| 1910 | first end |
| 1920 | second end |
| 1950 | base |
| 1960 | pivot point |
| 1970 | spring |
| 1972 | arrow |
| 2000 | locking tip |
| 2010 | locking cavity |
| 2011 | upwardly sloped or curved section |
| 2014 | maximum extend of upwardly sloped portion |
| 2050 | outwardly sloped portion |
| 2100 | arrow |
| 2500 | arrow |
| 2502 | arrow |
| 2510 | arrow |
| 2512 | arrow |
| 2520 | arrow |
| 2522 | arrow |
| 2530 | arrow |
| 2532 | arrow |
| 2540 | arrow |
| 2542 | arrow |
| 2550 | arrow |
| 2552 | arrow |
| 2560 | arrow |
| 2562 | arrow |
| 2570 | arrow |
| 2572 | arrow |
| 2580 | arrow |
| 2582 | arrow |
| 2590 | arrow |
| 2592 | arrow |
| 2600 | arrow |
| 2602 | arrow |
| 2610 | arrow |
| 2613 | arrow |
| 2620 | arrow |
| 3000 | item |
| 3010 | arrow |
| 3012 | arrow |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

I claim:

1. A decompression chamber in an environment, the decompression chamber having an interior and comprising:

an air tight transfer vessel fluidly connected to the interior of the decompression chamber;

the transfer vessel having an interior with first and second ends and openings at each end, wherein a peripheral ring is attached to the first end, said peripheral ring having an outer periphery and recesses;

an outer door detachably and rotatably mounted in the peripheral ring, said outer door having one or more locking projections that must align with said recesses before said outer door is closed;

an inner door mounted at the second end;

a first lock having a locking member operatively connected to the outer door, the locking member including a pin sliding between locked and unlocked states and into and out of one of said recesses, wherein when moving from the locked state to the unlocked state, the locking member moves from the one of said recesses to a position closer to the inner door and away from the one of said recesses, wherein when in the locked state, rotation of the outer door is restricted by the locking member in a first direction, a valve operatively connected to the lock and fluidly connected to the interior of the vessel, said valve having a valving member that is movable between opened and closed positions, manually operable linkage that simultaneously:

1) moves the pin of the locking member to slide between the locked and the unlocked states responsive to a manual movement of the linkage; and 2) moves the valving member between the closed and opened positions;

wherein when the linkage moves the pin of the locking member the locked to the unlocked state, the restriction to rotation of the outer door in the first direction by the locking member is removed, and the valving member is simultaneously moved to the open position, fluidly connecting the interior of the transfer vessel to the environment.

2. The chamber of claim 1, wherein the outer door is rotationally mounted on a support, and the support is pivotally movable in relation to the first end of the vessel, the outer door being rotatable about a rotation axis, the support being pivotal about a pivotal axis, and the rotation axis being about 90 degrees offset from the pivotal axis.

3. The chamber of claim 2, wherein the support includes an arcuate slot with first and second arcuate ends, the outer door includes a rotation stop, and an interaction between the rotation stop and the first and second arcuate ends restrict an extent of rotational movement between the outer door and the support in first and second rotational directions.

4. The chamber of claim 3, wherein the peripheral ring includes a plurality of ring locking tabs, and the outer door includes a plurality of the locking projections, and when the rotation stop is in contact with the first arcuate end of the arcuate slot, at least one of the ring locking tabs is in contact with at least one of the locking projections and pivotal movement between the outer door and the peripheral ring is restricted, and when the rotation stop is in contact with the second arcuate end of the arcuate slot, the pivotal movement between the outer door and the vessel peripheral ring is allowed.

5. The chamber of claim 1, wherein the peripheral ring has a plurality of ring locking tabs, and wherein when at least one of the ring locking tabs is in contact with at least one of the one or more locking projections, pivotal movement between the outer door and the peripheral ring is restricted.

6. The chamber of claim 5, wherein when the plurality of locking tabs are in contact with the at least one of a the one or more locking projections, the outer door seals the interior of the vessel from the environment.

7. The chamber of claim 1, wherein a second lock is operatively connected to the outer door and the first lock, the second lock having locked and unlocked states, the unlocked state of the second lock being time delayed at least by a predetermined time period from an entering of the unlocked state of the first lock.

8. The chamber of claim 1, wherein the predetermined time delay is between about 5 and about 60 seconds.

9. The chamber of claim 1, wherein a second lock includes a second locking member operatively connected to the outer door, the second lock having locked and unlocked states, the second lock comprising a piston and cylinder fluidly connected to the interior of the chamber and operatively connected to the second lock's locking member, so that as pressure of the interior of the vessel rises the second lock moves to the locked state.

10. The chamber of claim 9, wherein when the pressure of the interior of the vessel decreases, the second lock moves to the unlocked state.

11. The chamber of claim 9, wherein when the second locking member moves from the unlocked state to the locked state, the second locking member moves farther away from the inner door.

12. The chamber of claim 9, wherein when the second locking member moves between the locked and unlocked states, the second locking member slides parallel to a centerline of the interior of the vessel.

13. The chamber of claim 12, wherein the peripheral ring has a peripheral groove guiding rotation of the outer door and the peripheral ring has a geometric plane bisecting the peripheral groove, and the second locking member has a front tip, and when the second locking member moves from the locked state to the unlocked state or from the unlocked state to the unlocked state the tip of the second locking member passes through the geometrical bisecting plane.

14. The chamber of claim 1, wherein the inner door is pivotally connected to the vessel, and a latch is operatively connected to the inner door, the inner door having at least two states: (a) a latched state wherein the latch limits the amount of pivotal movement between the inner door and the vessel and (b) an open state wherein the latch is disconnected from the inner door.

15. The chamber of claim 14, wherein when in the latched state, the inner door fluidly seals the interior of the chamber with respect to the interior of the vessel when there exists a higher pressure in the interior of the chamber compared to the interior of the vessel.

16. The chamber of claim 14, wherein when in the latched state, the inner door can fluidly vent the interior of the vessel to the interior of the chamber where there exists a small differentially higher pressure in the interior of the vessel compared to the interior of the chamber.

17. The chamber of claim 1, further comprising a safety lock operationally connected to the outer door and preventing rotational movement of the outer door before pressure inside the vessel is equalized with pressure outside of the vessel.

18. The chamber of claim 17, wherein the safety lock includes a piston chamber in air communication with the inside of the vessel, a piston slidably moveable inside the piston chamber, and a safety lock pin operationally connected to the piston and engageable with one of the one or more locking projections to prevent rotational movement of the outer door in the first direction.

19. The chamber of claim 18, wherein the safety lock further includes a compression spring normally urging the piston into a retracted position, and moving the safety lock pin out of engagement with the locking ring one of the one or more locking projections.

20. An interlock assembly for use with decompression chambers comprising:

an air tight vessel provided with one opening at each of the vessel ends, and a sidewall extending between opposing ends of the vessel, the sidewall being provided with a peripheral ring secured at an exterior end of the vessel;

an outer door mounted at the exterior end of the vessel and configured to engage said peripheral ring in a closed door and locked position, the outer door being adapted for a limited rotational and pivotal movement in relation to the exterior end of the vessel;

an inner door mounted at an interior end of the vessel, the inner door selectively communicating with the decompression chamber when the inner door is open;

cooperating recesses and projections that form an interface between said peripheral ring and said outer door wherein said outer door is not able to be opened or closed when said projections do not align with said recesses;

a manually operable first lock mounted at the exterior end of the vessel for selectively locking the outer door in a sealed engagement with the exterior end of the vessel, the first lock allowing the outer door to move between the locked position and a plurality of selectively open positions, the first lock including at least one sliding lock pin that moves between a first, unlocked position to a second, locked position that prevents rotational movement of the outer door, wherein said sliding lock pin extends into one recess of said recesses; wherein when moving from the second locked position to the first unlocked position, the sliding lock pin moves from the one recess to a position closer to the inner door and away from the one recess, a second lock mounted at the exterior end of the vessel which second lock is fluidly connected to the first lock, the second lock allowing the outer door to move between the locked position and the plurality of selectively open positions, the second lock including at least one sliding lock pin for preventing rotational movement of the outer door;

wherein rotational movement of the outer door is prevented when at least one of the first lock is in the second locked position or the second lock is in a locked position;

a third lock detachably mounted at the exterior end of the vessel for selectively locking the inner door in a sealed engagement with the inner end of the vessel; and a pressure relief valve operationally connected to the first lock for rapidly and simultaneously venting pressure inside the vessel when the first lock is manually moved to said first, unlocked position, said pressure relief valve having a valving member that is movable between opened and closed positions, manually operable linkage that simultaneously:

1) moves the sliding lock pin of the first lock to slide between the second locked position and the first unlocked position responsive to a manual movement of the linkage; and 2) moves the valving member between the closed and opened positions wherein when the linkage moves the sliding lock pin of the first lock from the second locked position to the first unlocked position, the rotational movement of the outer door is no longer prevented by the sliding lock pin of the first lock, and the valving member is simultaneously moved to the open position, fluidly connecting the inside of the vessel to an exterior environment.

21. A decompression chamber apparatus, comprising:

a) a chamber having an interior surrounded by a chamber wall;

b) a transfer vessel attached to the chamber wall and in fluid communication with the chamber interior;

c) the transfer vessel having an interior with first and second ends and openings at each of said first and second ends, wherein a peripheral ring is attached to the first end;

d) an outer door rotatably mounted in the peripheral ring;

e) cooperating recesses and projections that form an interface between said peripheral ring and said outer door wherein said outer door is not able to be opened or closed when said projections do not align with said recesses;

f) an inner door mounted at the second end;

g) a lock having a sliding locking pin operatively connected to the outer door, the sliding locking pin being movable with linkage, that includes a handle, between locked and unlocked positions and into and out of one of said recesses responsive to manual operation of the handle, wherein when moving from the locked position to the unlocked position, the sliding locking pin moves from the one of said recesses to a position closer to the inner door and away from the one of said recesses;

h) wherein when in the locked position, rotation of the outer door is restricted by the sliding locking pin occupying the one of said recesses;

i) a valve operatively connected to the lock and fluidly connected to the interior of the transfer vessel, said valve having a valving member that is movable between opened and closed positions, j) the handle mounted to an outside of the transfer vessel, said handle being rotatable between first and second positions; and k) wherein rotation of the handle from the first to the second position effects simultaneous movement of:

1) the sliding locking pin between the locked and the unlocked positions; and 2) the valving member between the closed and opened positions;

wherein when the linkage moves the sliding locking pin from the locked to the unlocked position, the restriction to rotation of the outer door by the sliding locking pin is removed, and the valving member is simultaneously moved to the open position fluidly connecting the interior of the transfer vessel to an exterior environment.

22. The chamber of claim 21 wherein the handle is manually operable.

23. The chamber of claim 21 wherein the sliding pin slides along a linear path.

24. The chamber of claim 21 wherein the valving member is a rotating member.

* * * * *